US011175111B2

(12) United States Patent
Akyol

(10) Patent No.: US 11,175,111 B2
(45) Date of Patent: Nov. 16, 2021

(54) MECHANISM STRUCTURE FOR FIREARMS

(71) Applicant: ARMSAN SILAH SANAYI VE TICARET ANONIM SIRKETI, Istanbul (TR)

(72) Inventor: Nejat Akyol, Istanbul (TR)

( * ) Notice: Subject to any disclaimer, the term of this patent is extended or adjusted under 35 U.S.C. 154(b) by 0 days.

(21) Appl. No.: 16/642,645

(22) PCT Filed: Jul. 13, 2018

(86) PCT No.: PCT/TR2018/050368
§ 371 (c)(1),
(2) Date: Feb. 27, 2020

(87) PCT Pub. No.: WO2019/190418
PCT Pub. Date: Oct. 3, 2019

(65) Prior Publication Data

US 2021/0156635 A1 May 27, 2021

(30) Foreign Application Priority Data

Oct. 10, 2017 (TR) ..... 2017/15303

(51) Int. Cl.
*F41A 19/34* (2006.01)
*F41A 5/26* (2006.01)

(52) U.S. Cl.
CPC ..... *F41A 19/34* (2013.01); *F41A 5/26* (2013.01)

(58) Field of Classification Search
CPC ..... F41A 19/34; F41A 19/27; F41A 19/28; F41A 19/29; F41A 19/30; F41A 5/26; F41A 5/18; F41A 5/24; F41A 5/30
USPC ..... 89/193, 194, 191.01, 191.02, 192
See application file for complete search history.

(56) References Cited

U.S. PATENT DOCUMENTS 1,572,450 A * 2/1926 Swebilius ..... F41A 3/40 89/144
2,396,564 A * 3/1946 Gal ..... F41A 3/46 89/152
2,554,618 A * 5/1951 Paulh ..... F41A 5/22 89/193
2,601,808 A * 7/1952 Clarke ..... F41A 3/40 89/190
2,730,928 A * 1/1956 Saetter-Lassen ..... F41A 3/40 89/190
2,960,917 A * 11/1960 Lizza ..... F41A 3/26 89/190
3,405,471 A * 10/1968 Koncky ..... F41A 3/64 42/75.02
10,215,513 B2 * 2/2019 Cross ..... F41C 23/04
(Continued)

FOREIGN PATENT DOCUMENTS

WO 2009056176 A1 5/2009
WO 2016019297 A1 2/2016

OTHER PUBLICATIONS

International Search Report for corresponding PCT/TR2018/050368.
Written Opinion of the ISA for corresponding PCT/TR2018/050368.

*Primary Examiner* — John Cooper
(74) *Attorney, Agent, or Firm* — Egbert, McDaniel & Swartz

(57) ABSTRACT

Disclosed is a new rifle mechanism that can be used in both rifles and shotguns, which has a higher firing power because of included components and allows the rifle structure to be used more efficiently.

7 Claims, 28 Drawing Sheets

(56) References Cited

U.S. PATENT DOCUMENTS

| | | | | |
|---|---|---|---|---|
| 2014/0224114 | A1* | 8/2014 | Faxon | F41A 3/66<br>89/193 |
| 2016/0047614 | A1 | 2/2016 | Larson, Jr. | |
| 2016/0305730 | A1 | 10/2016 | Dextraze | |

* cited by examiner

MECHANISM STRUCTURE FOR FIREARMS

TECHNICAL FIELD OF THE INVENTION

The present invention relates to a new firearm mechanism that is designed for both shotgun and rifle structures, enables to shoot rapidly and has a high shooting power thanks to the structure that it has.

STATE OF ART

Firearm structures are typically grouped as rifles and shotguns in the state of art. Rifles has a structure in which interior surface of the barrel is comprised of rotative lines that are symmetrical to each other. Rifles has a higher firepower, therefore increasing hit ratio due to the fact that interior surface of the rifle barrels are in a rotative form. Yet, interior surface of the barrel is smooth in shotguns. This negatively affects hit ratio, firepower and shooting range.

There is a lot of firearm structures known from the state of art. These firearm structures may comprise firing mechanisms comprised of different components and arrangements. Said mechanism structures carry out respectively various processes. Taking new cartridge, which is to be fired in the firearm structures enabling to shoot successively without interfering, from magazine structure and positioning it into the barrel is one of the processes that said mechanisms carry out. Firing a cartridge by means of a pin in its structure hitting onto percussion cap can be given as another example for the processes that mechanisms carry out Lock system, which enables powder gas resulting from the cartridge fired to push bullet or shots, constitutes an example for component groups in firearm mechanisms. The mechanism structures may be in different shapes such as rotative head, ball etc.

The patent application WO 2009056176 in the state of art discloses a new firearm structure enabling to shoot successively and details of the mechanism.

The patent application US2016305730 and WO2009056176 in the state of art discloses another gun structure. Said gun structure is a mechanism developed for firearm structures.

OBJECTIVE OF THE INVENTION

Objective of the invention is to provide a new firearm mechanism that can be used in both rifle and shotgun structures.

Another objective of the invention is to provide a new firearm mechanism comprising a lock system that works with a less gas leak.

Another objective of the invention is to provide a new firearm mechanism that has a higher firepower.

Another objective of the invention is yet to provide a new firearm mechanism with a lower recoil level thanks to the lock system, which it has, works perpendicular axis.

1. Guide Rod
2. Recoil Spring
3. Spring Plate
4. Recoil Spring Tube
5. Firing Pin
6. Mechanism Left Cover
7. Pin Segment
8. Mechanism Right Cover
9. Extractor
10. Extractor Spring
11. Tether Pin for Firing Pin
12. Extractor Pin
13. Firing Pin Spring
14. Mechanism Head
15. Mechanism Mounting Pin
16. Cover Mounting Pin
17. Movement Hole
18. Tether Bearing
19. Cover Pin Housing
20. Small Tube Housings
21. Wide Tube Housings
22. Extractor cavities
23. Lock Protrusion
24. Segment Housing
25. Cocking Handle Protrusion
26. Cocking Handle Housing
27. Firing Pin Cavity
28. Push Rail Housing
29. Pin Cavity
30. Firing Pin Housing
31. Push Tube Holes
32. Extractor Spring Cavity
33. Extractor Housing
34. Head Pin Housing

35. Tether Pin Housing
36. Push Rail Spaces
37. Small Tube Protrusions
38. Wide Tube Protrusions
39. Rod Housing
40. Gas Hole
41. Gas Chamber
42. Gas Piston
43. Gas Chamber Lid
44. Discharge Holes
45. Cartridge Holding Protrusion
46. Spring Stopper
47. Cartridge Base Space
48. Spring Protrusion
49. Extractor Pin Housing
50. Mechanism Rail
51. Lock Housing
52. Magazine Disc
53. Barrel Crown
54. Push Spring
55. Cocking Handle Segment
56. Push Rail
57. Push Tube
58. Cocking Handle
59. Push Tube Pin
60. Tube Lid
61. Barrel
62. Lid Pin

DESCRIPTION OF THE INVENTION

The invention relates to a new mechanism structure designed for both rifles and shotguns, comprising a lock system that works in a perpendicular position, with a lower recoil level and having an increased firing power by means of a small amount of gas leak.

Figure 1:
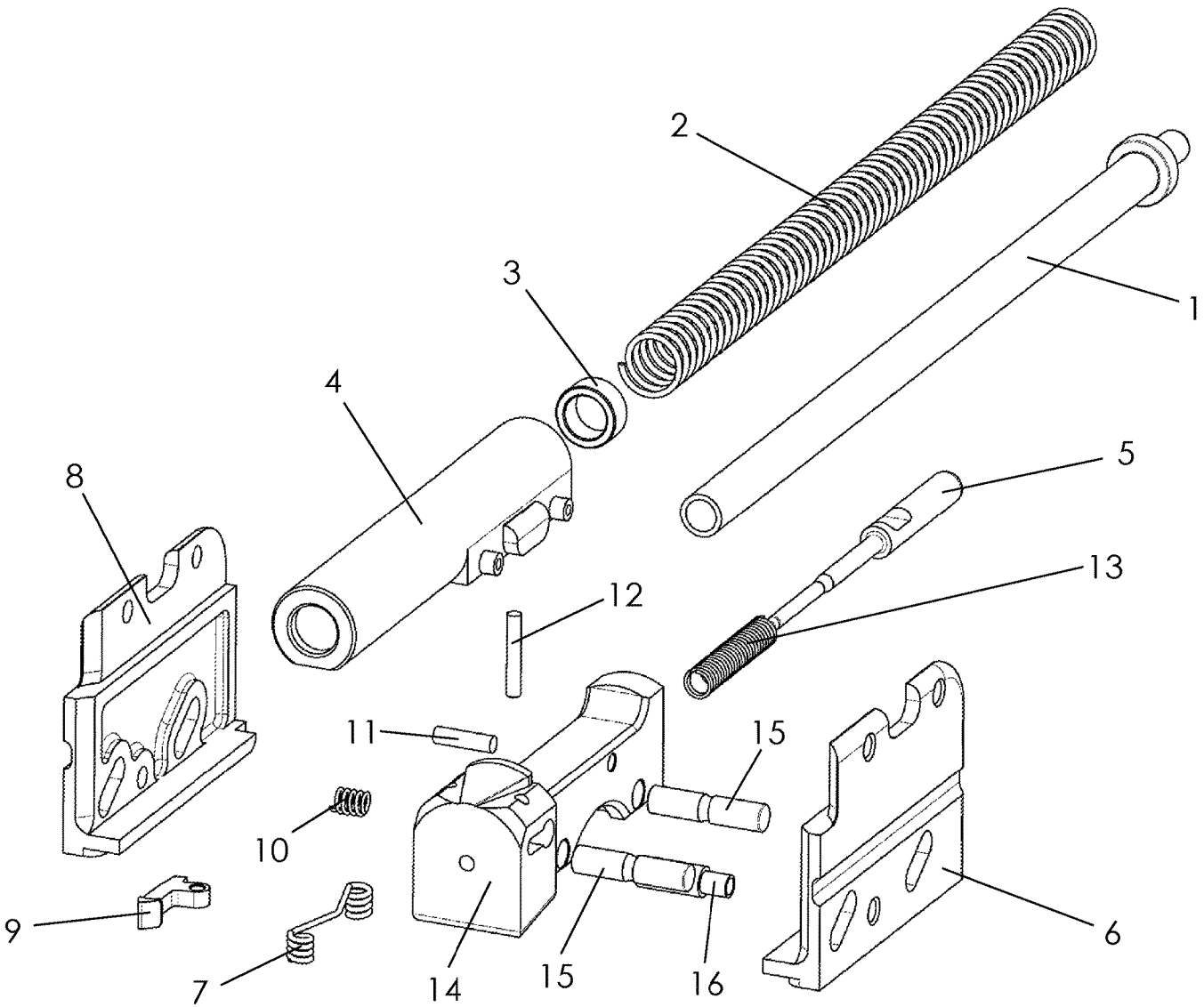
FIG. 1. Unmounted mechanism group—Perspective view
Figure 2:
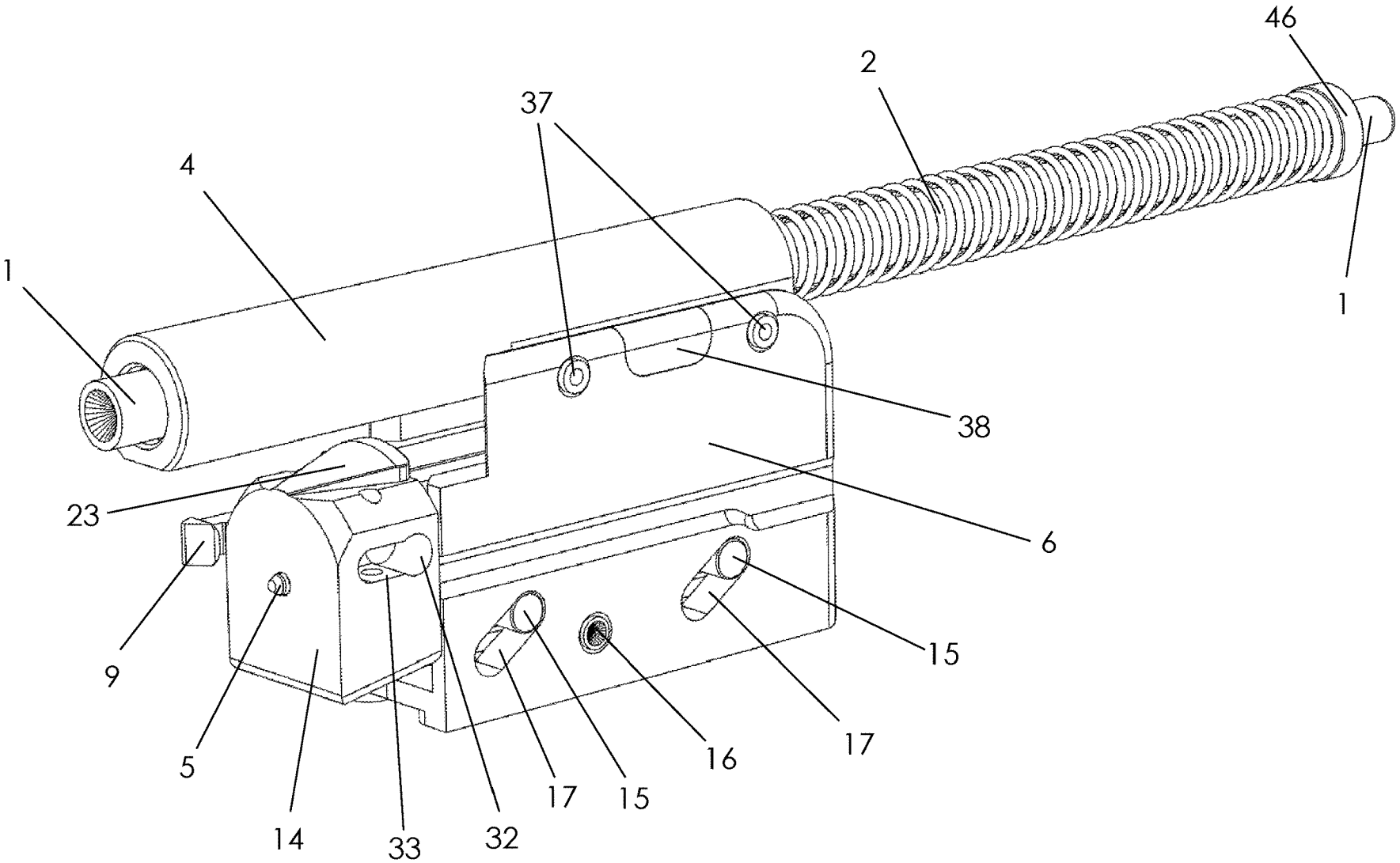
FIG. 2. Mounted mechanism group—Front perspective view

Mechanism structure, the subject matter of the invention, comprises a mechanism blog carrying out the firing process. Exploded view of said mechanism group can be seen in FIG. 1. Further, said mechanism structure comprises a particular barrel group so as to properly carry out the firing process. Exploded view of said barrel group can be seen FIG. 16. Trigger mechanism, cock structure, magazine structure, etc. other members that needs to exist in firearm structures, in which mechanism structure subject to the invention exists, may be standard structures.

Figure 3:
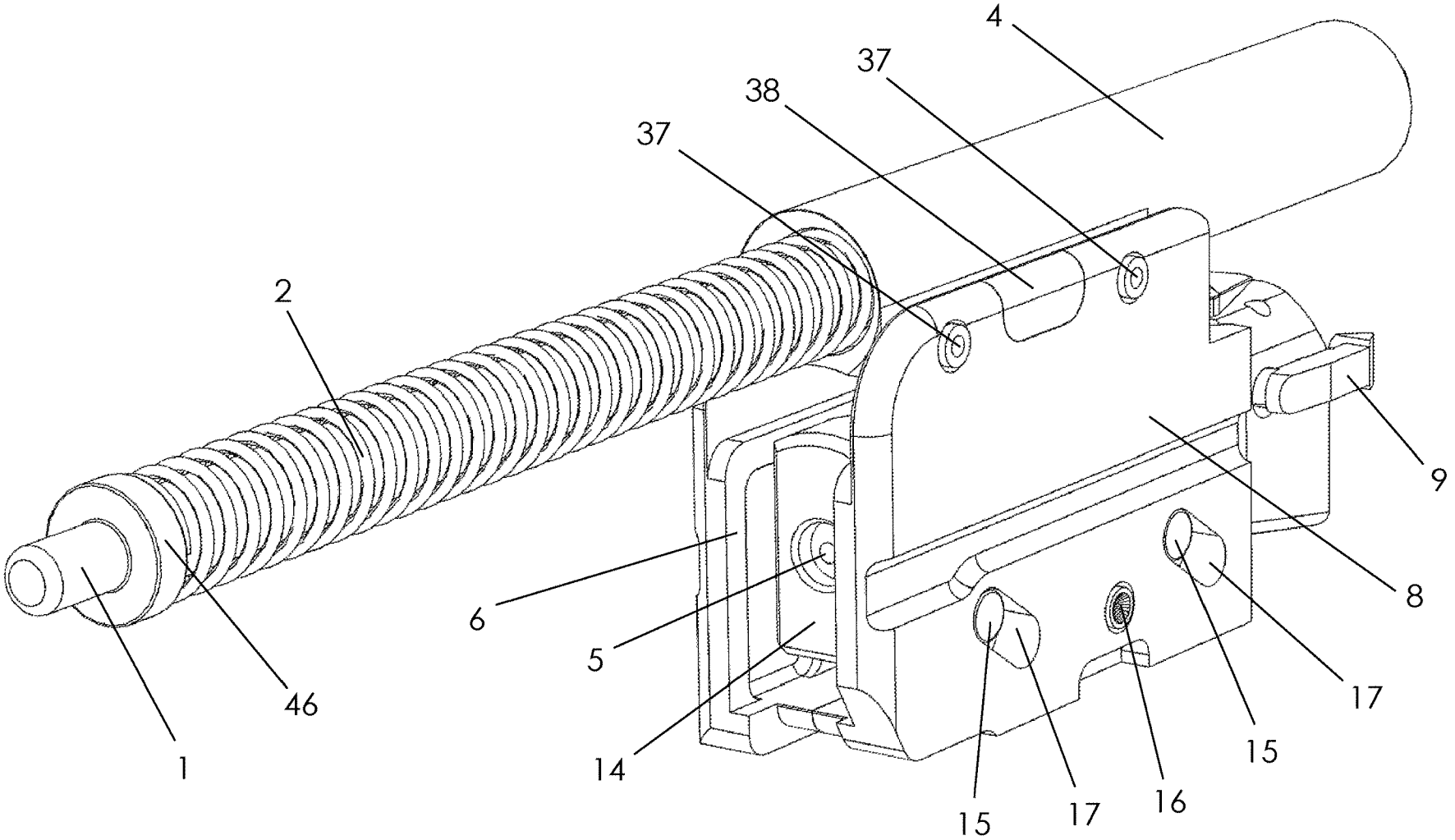
FIG. 3. Mounted mechanism group—Back perspective view
Figure 12:
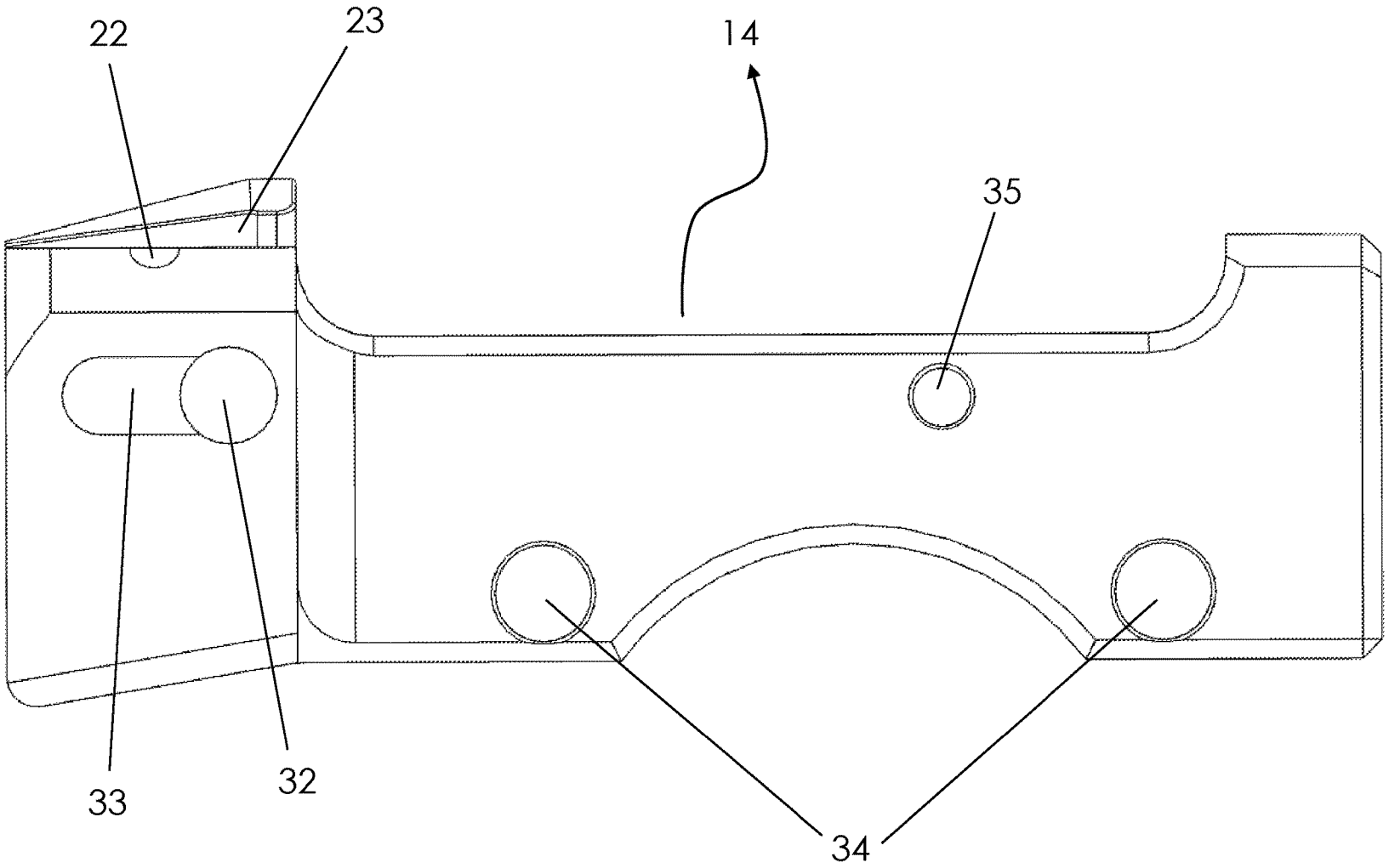

Mechanism group existing in the central position of mechanism structure subject to the invention is positioned such that it exactly coincides with the back portion of the barrel (61) structure. Mechanism group, as also can be seen in FIG. 3, is comprised of a mechanism head (14) in the center, and mechanism right cover (8) and mechanism left cover (6) that are positioned at the two opposing sides of the mechanism head (14) and are in a symmetrical form according to each other. Mechanism right cover (8) and mechanism left cover (6) helps mechanism head (14) with the movements to be carried out. Mechanism right cover (8) and mechanism left cover (6) are positioned such that they are opposing to sides of mechanism head (14). Positioned covers are mounted to each other by means of each cover pin housing (19) that exists at lower portions and faces each other. One cover mounting pin (16) mounts said cover structures to each other by means of inserting each end into a cover pin housing (19). As can be seen in FIG. 12, there is an oval space formed at lower surface of mechanism head (14) so that mechanism head (14) does not prevent cover mounting pin (16) from getting mounted. Cover mounting pin (16) can be connected to both cover structures without making a contact with the mechanism head (14) by means of said space.

Connection of the mechanism head (14) with the mechanism right cover (8) and mechanism left cover (6) is realized by means of two mechanism mounting pins (15). Said mechanism mounting pins (15), as can be seen in FIG. 12, are positioned into two head pin housings (34) located on the side surfaces such that they are close to lower edge of the body of mechanism head (14). End portions of mechanism mounting pins (15) positioned in head pin housings (34) remain outside of the mechanism head (14). Ends of mechanism mounting pins (15) remaining outside enter into movement holes (17) that are symmetrical on the mechanism right cover (8) and mechanism left cover (6) and exist in twos on each cover.

Figure 8:
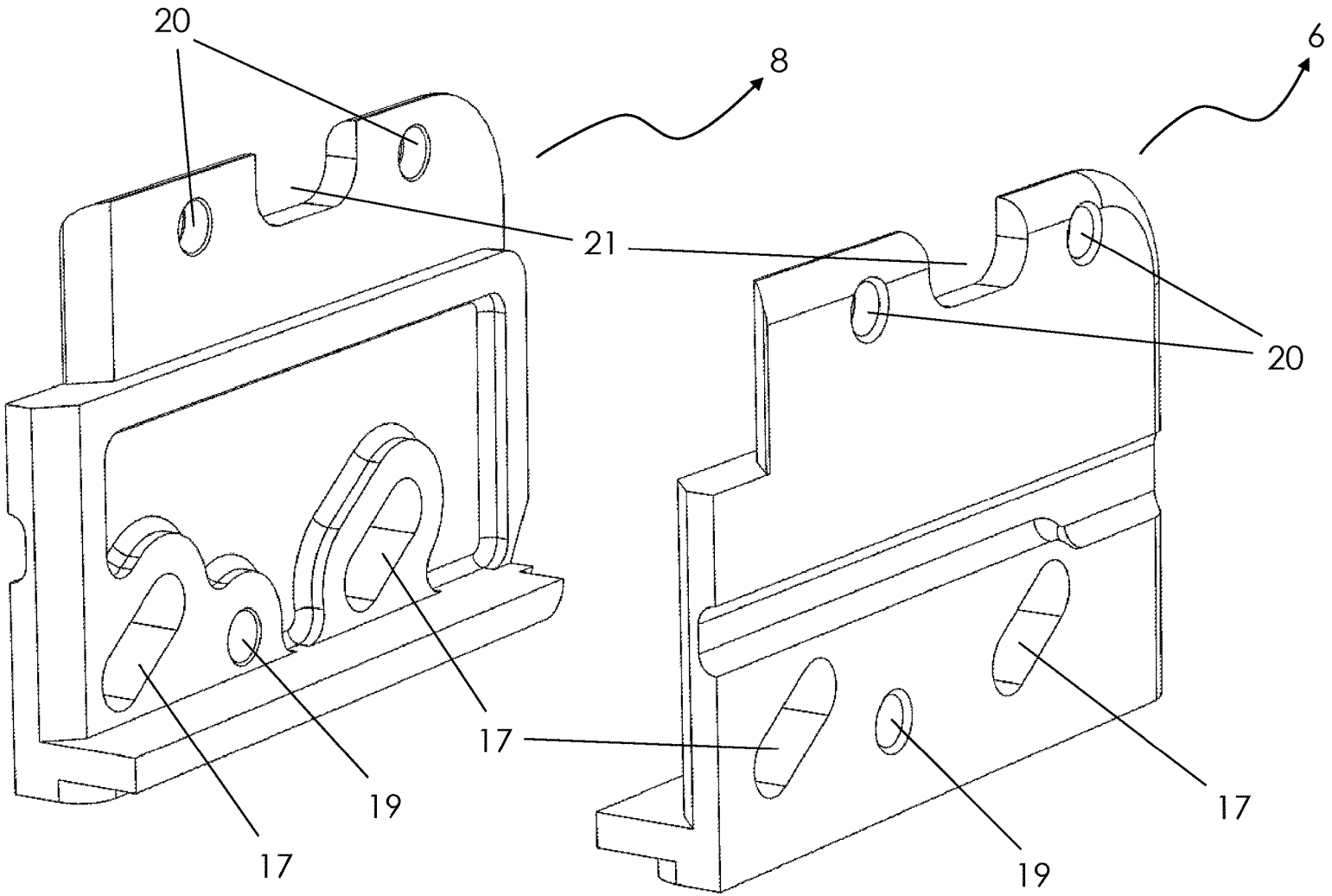
FIG. 8. Mechanism left cover and mechanism right cover that are positioned opposing—Perspective view FIG. 9. Extractor—Perspective view FIG. 10. Extractor—Top view FIG. 11. Mechanism head—Front-Top perspective view FIG. 12. Mechanism head—Side view FIG. 13. Mechanism head—Back-Bottom perspective view FIG. 14. Mechanism head in which firing pin, pin segment and extractor are positioned—Back-Bottom perspective view FIG. 15. View of positions of firing pin, pin segment and extractor subsequent to montage without mechanism head.

Said movement holes (17), as also can be seen in FIG. 8, are in a longitudinal space form. This enables ends of mechanism mounting pins (15) to move in and out in the movement holes (17). However, the direction in which the movement holes (17) expand is not parallel to horizontal or perpendicular plane. Said direction comprises a slope such that it constitutes approximately 35 degree angle according to ground plane. Movements, which mechanism head (14) carries out depending on firing through the fact that end portions of mechanism mounting pins (15) stay in movement holes (17), is a such extent that movement holes (17) allow mechanism mounting pins (15). Shape of space that the movement holes (17) comprises restricts movements of mechanism head (14). Movement of the mechanism head (14) takes place in accordance with the movement which mechanism mounting pins (15) carries out along axis of the movement holes (17).

Figure 13:
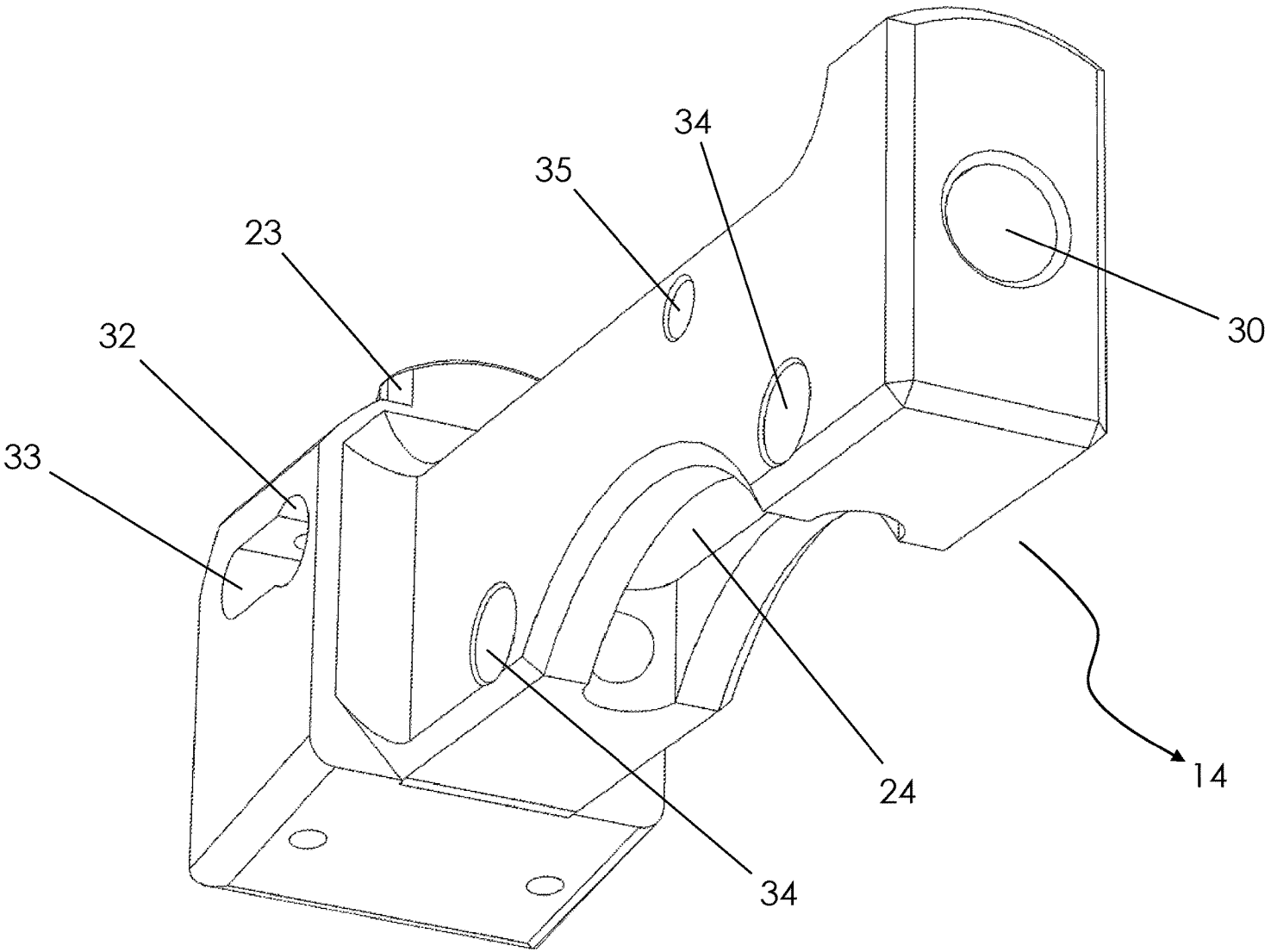
Figure 14:
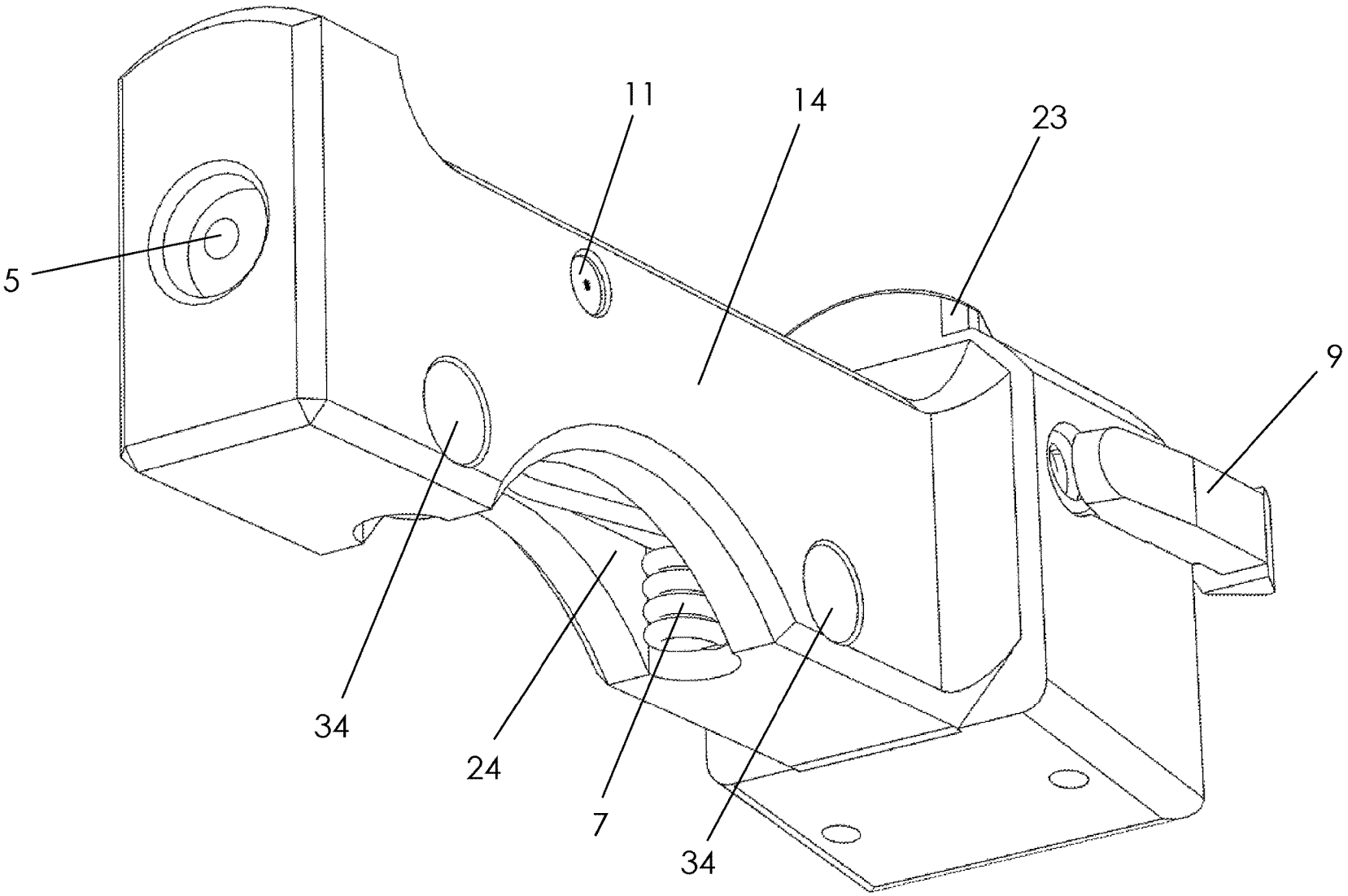
Figure 15:
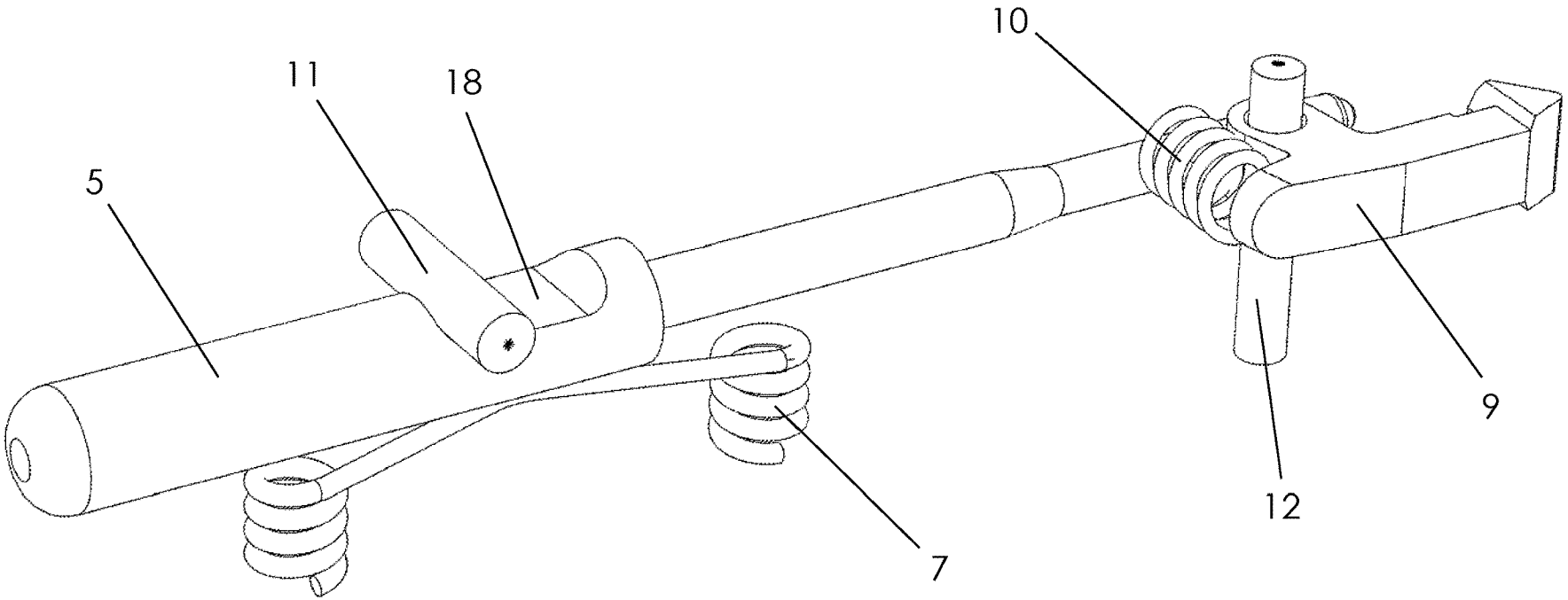

As can be seen in FIG. 13, there is a space structure expanding inwardly on the lower surface of mechanism head (14). Said space structure is the segment housing (24). Segment housing (24) exists in the very center of oval space structure formed on the lower surface of mechanism head (14) so as to block the cover mounting pin (16). Pin segment (7), as can be seen in FIG. 14, is positioned into the segment housing (24). Pin segment (7) has a structure of which two ends are in a spring form and of which said ends exactly coincide with bottom of the cover mounting pins (16). Main objective of the pin segment (7) is to prevent cover mounting pins (16) from moving in perpendicular direction in accordance with the ground plane.

Firing pin (5) structure, to which cock structure strikes to start the firing, are positioned in the firing pin housing (30) on the back surface of mechanism head (14), in case the firearm structure in which the mechanism structure subject to the invention is triggered so as to be fired. Said firing pin (5) enters through firing pin housing (30) on the back surface of mechanism head (14), however end portion of firing pin (5) may stick out of firing pin cavity (27) on the front surface of the mechanism head (14). End portion of firing pin (5) that may stick out of firing pin cavity (27) is thinner than its remaining section.

A firing pin spring (13) is located in the section in which the thinner end of firing pin (5) structure positioned in the mechanism head (14) exists. Firstly, the firing pin spring (13), then the firing pin (5) enters in firing pin housing (30). Objective of said firing pin spring (13) is to enable the firing pin (5) moving forward so as to carry out the firing process to take back its old position. There is a tether pin housing (35) at the point close to upper edge of the side surface of mechanism head (14). After the firing pin (5) is positioned in the firing pin housing (30), a tether pin for firing pin located in the tether pin housing (35) and firing pin (5) structure are fixed into the mechanism body (14). There is some space in the section which tether pin for firing pin (11) coincides with on the upper of portion of firing pin (5). Tether pin for firing pin (11) is placed on said tether bearing (18) on the firing pin (5). Thus, Firing pin (5) structure forced to move with the effect of firing pin spring (13) while in a normal position may stay in firing pin housing (30) because tether pin for firing pin (11) exists in tether bearing (18). Said tether bearing (18) on the upper surface of firing pin (5) expands slightly towards rear end of firing pin (5) structure. Therefore, there is some space at the back portion of tether pin for firing pin (11). In the course of firing, when firing pin (5) moves forward, tether pin for firing pin (11) moves along the tether bearing (18) and does not prevent firing pin (5) from moving.

While placing oppositely mechanism right cover (8) and mechanism left cover (6) at sides of mechanism head (6), a recoil spring tube (4) is placed exactly on the mechanism head (6) such that it coincides with between upper edges of mechanism right cover (8) and mechanism left cover (6). As can be seen in FIG. 3, said recoil spring tube (4) is fastened between mechanism right cover (8) and mechanism left cover (6). The covers are seated on the symmetrical protrusion structures being on side surfaces of recoil spring tube (4) so as to ensure fastening process. There are wide tube housings (21) exactly at the middle of upper edge sections of cover structures. Wide tube housings (21) are seated exactly on the wide tube protrusions (38) that are symmetrically positioned on the two side surfaces of recoil spring tube (4). Further, there are in total four small tube protrusions (37) on the side surfaces of recoil spring tube (4) such that they are on two sides of wide tube protrusions (38). While wide tube protrusions (38) are seated in wide tube housings (21), small tube protrusions (37) are seated in small tube housings (20) in twos on the cover structures. Small tube housings (20) are positioned such that they are at both edges of wide tube housings (21) on the upper section of cover structures. Therefore, while seating wide tube protrusions (38) in wide tube housings (21), small tube protrusions (37) are synchronously seated properly in the small tube housings (20). Thus, mechanism right cover (8) and mechanism left cover (6) are mounted very firmly to recoil spring tube (4).

Figure 4:
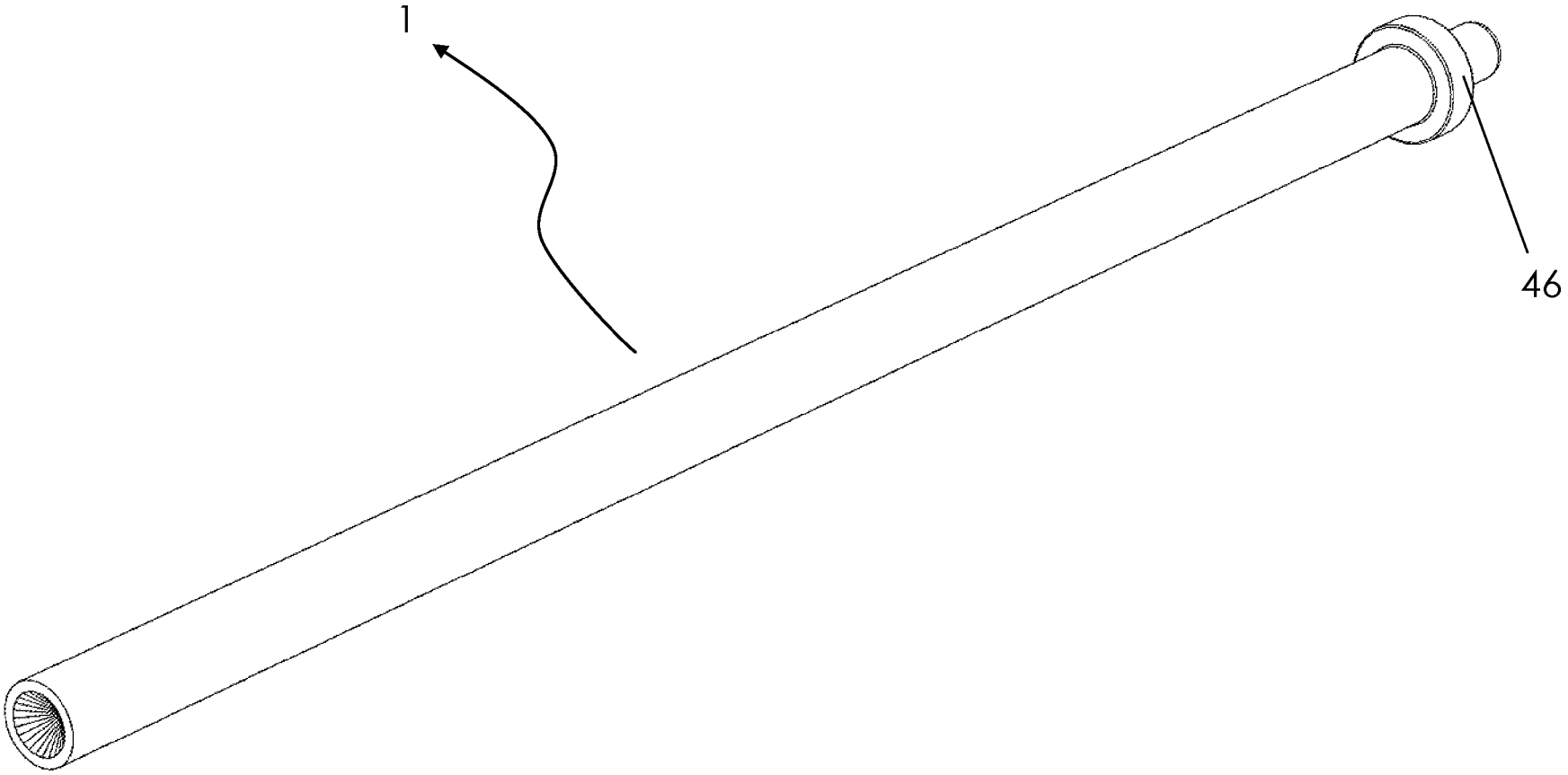
FIG. 4. Guide rod—Perspective view
Figure 5:
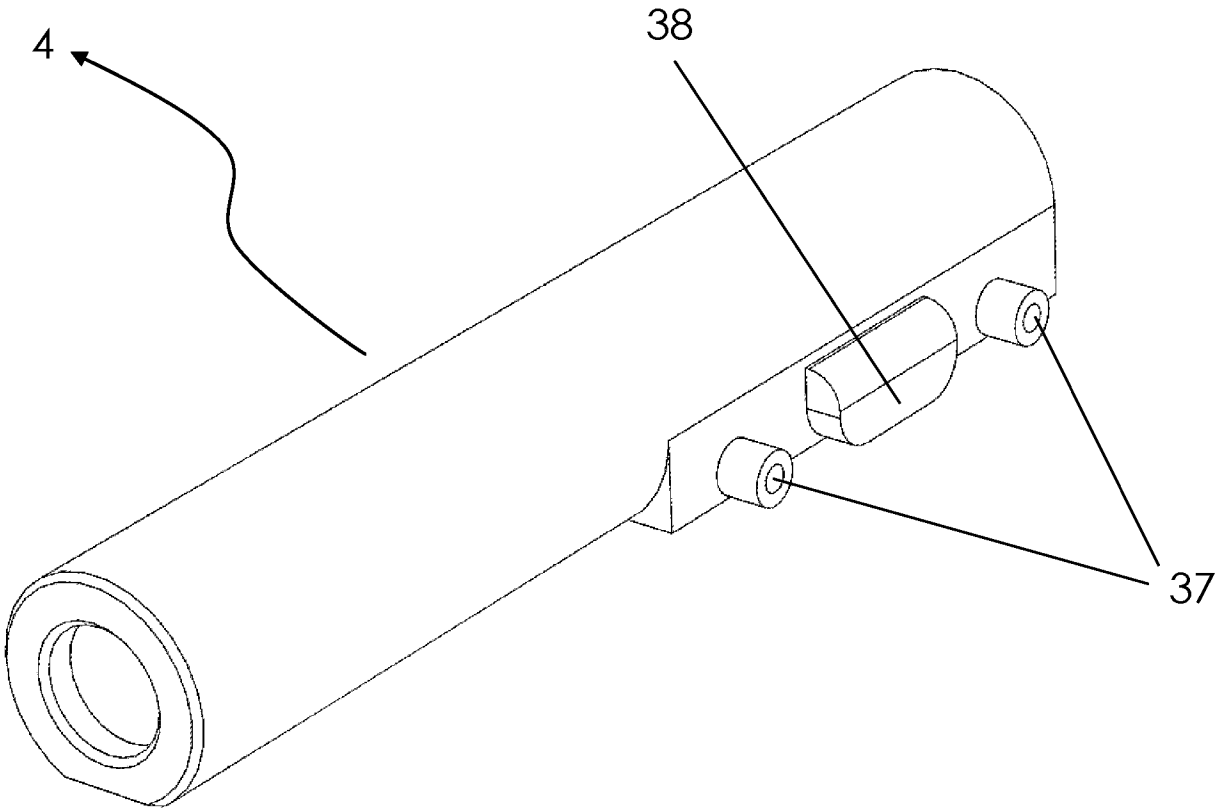
FIG. 5. Recoil spring tube—Front-Top perspective view
Figure 6:
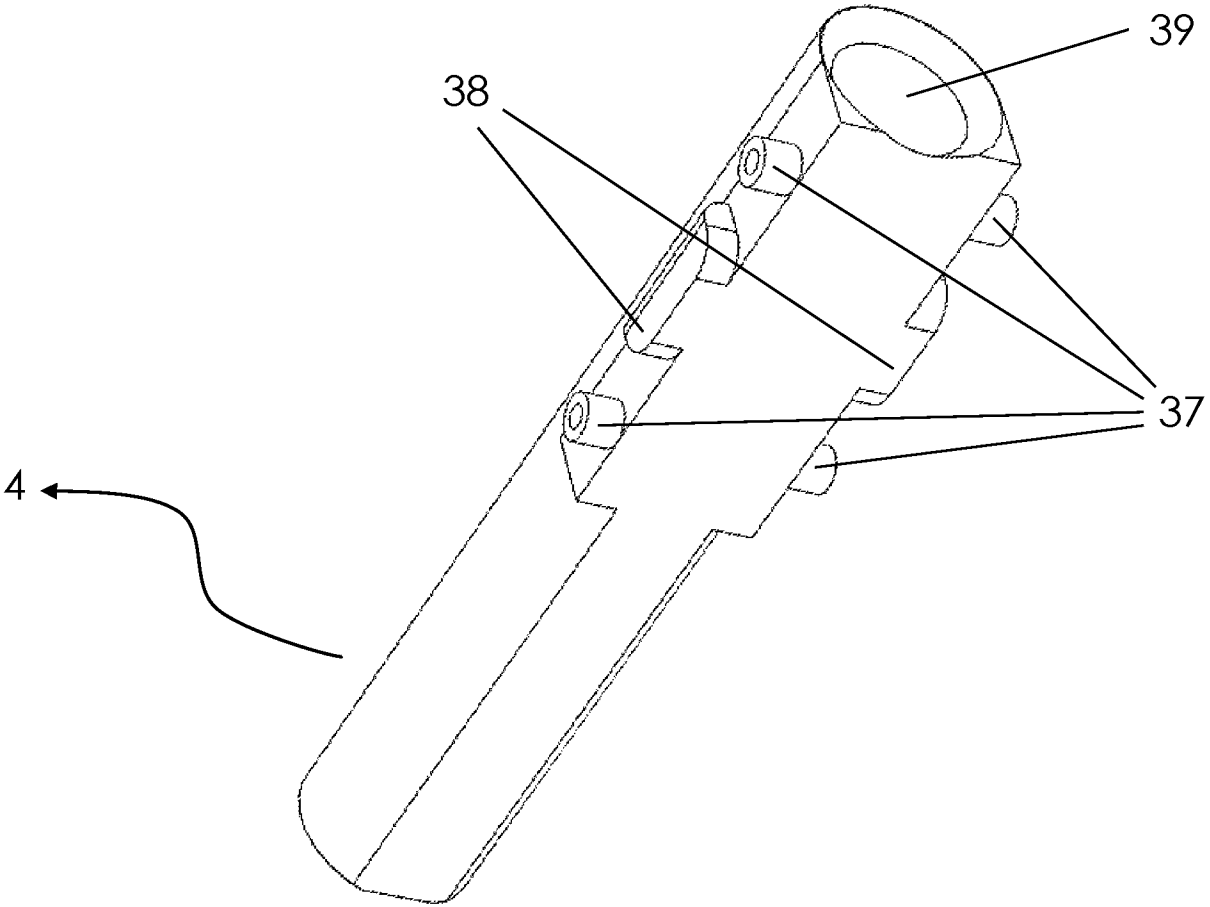
FIG. 6. Recoil spring tube—Back-Top perspective view
Figure 7:
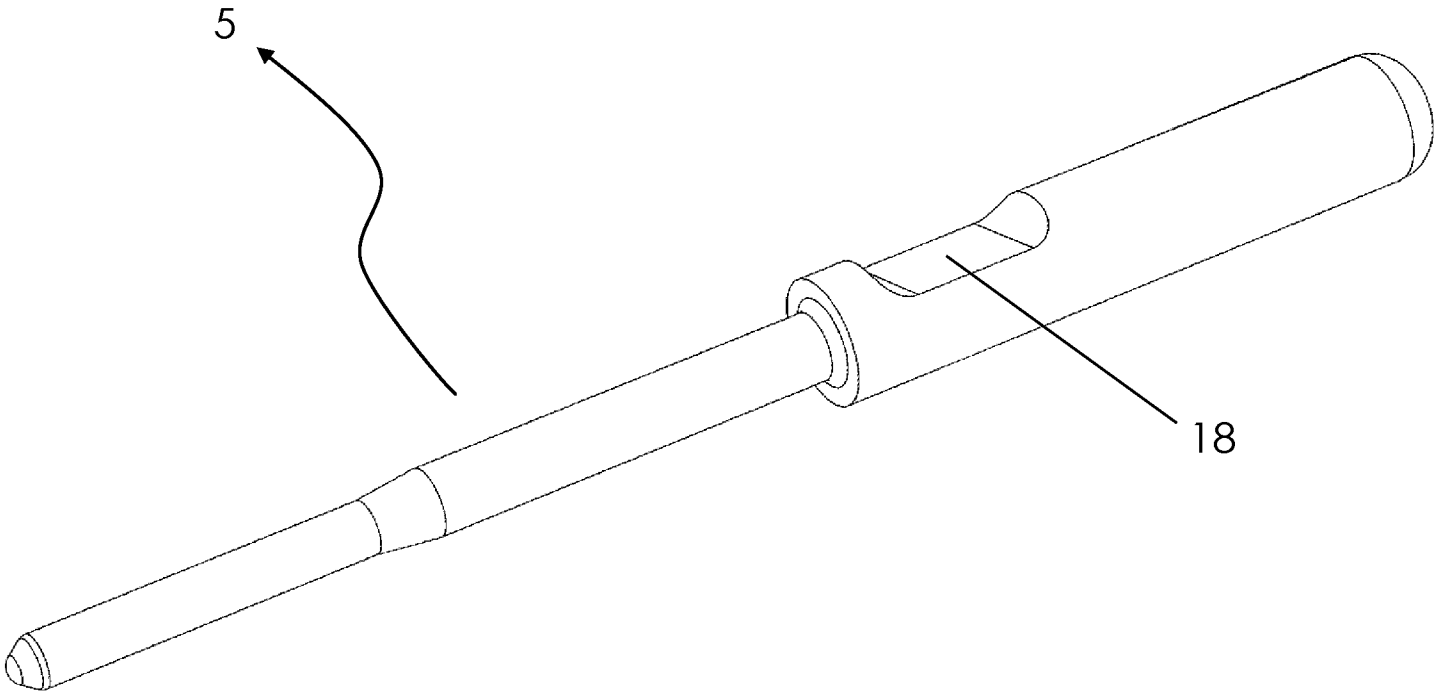
FIG. 7. Firing pin—Perspective view

There is a rod housing (39) in the form of cylindrical space expanding inward at the end portion facing to opposed side of barrel (61) of the recoil spring tube (4). There is another space structure with smaller diameter at the end facing to barrel (61) of the recoil spring tube (4). Guide rod (1) that can be seen in FIG. 4 is positioned in rod housing (39). Before positioning guide rod (1) in the rod housing (39), recoil spring (2) is seated on the end portion to be inserted in the guide rod (39). A spring plate (3) is attached to the same end of guide rod (1) after positioned on the guide rod (1) in order for recoil spring (2) to stay on the guide rod (1). Thus, recoil spring (2) can stay on the guide rod (1). Spring plate (3) can move on the guide rod (1). Further, Spring stopper (46) in the form of a protrusion that is positioned at the point close to the end with no spring plate (3) exists in the middle section of guide rod (1). Spring stopper (46) is a structure that prevents recoil spring (2) from moving backward on the guide rod (1) and helps recoil spring (2) with staying on the guide rod (1).

Guide rod (1), together with the recoil spring (2) thereon, is positioned in rod housing (39) at the back section of recoil spring tube (4) such that it is the end with spring plate (3). Diameter of the space at frond side of recoil spring tube (4) is smaller than diameter of spring plate (3). Therefore, the spring plate (3) positioned in recoil spring tube (4) at the end of guide rode (1) cannot stick out of the end at the front side of recoil spring tube (4). Main objective of the guide rod (1) is to guide the recoil spring (2) ejecting empty cartridge in the chamber and loading a new cartridge in the barrel (61) in the course of firing, and enabling to take back its location in the normal position by pushing the mechanism sliding backward so as to cock firearm from back side of the firearm towards front side in which the barrel (61) takes place.

Figure 9:
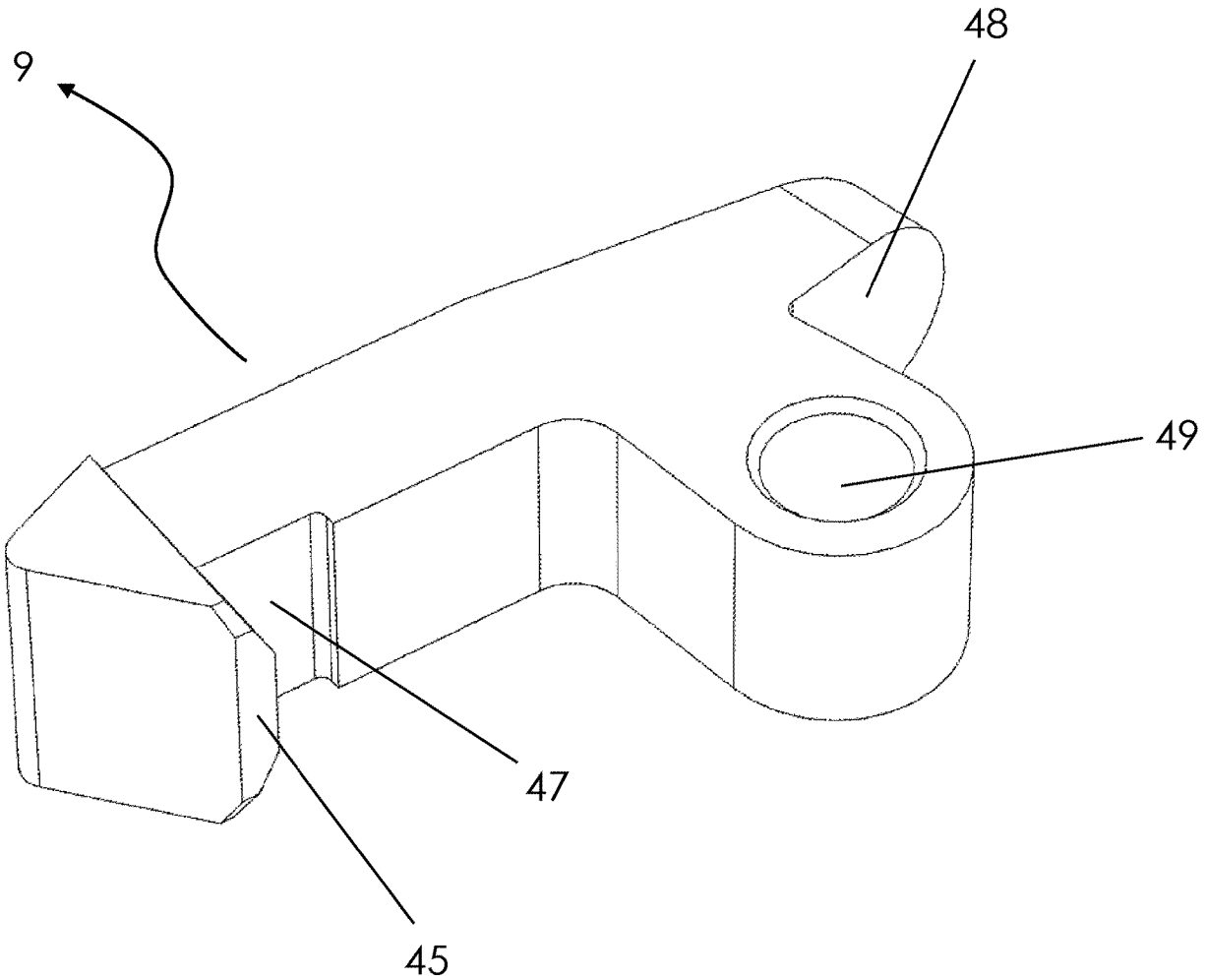

There is respectively one extractor housing (33), which is positioned symmetrically according to each other in both sides, at the front side in wide end portion of mechanism head (14). Extractor housings (33) are inward space structures on the side surfaces of mechanism head (14). Extractor (9) structure that can be seen in FIG. 9 is positioned in one of the extractor housings (33). The extractor housing (33), in which the extractor is to be positioned, is determined according to the direction which firearm structure ejects the empty case. Therefore, its position can be varied preferably.

Figure 10:
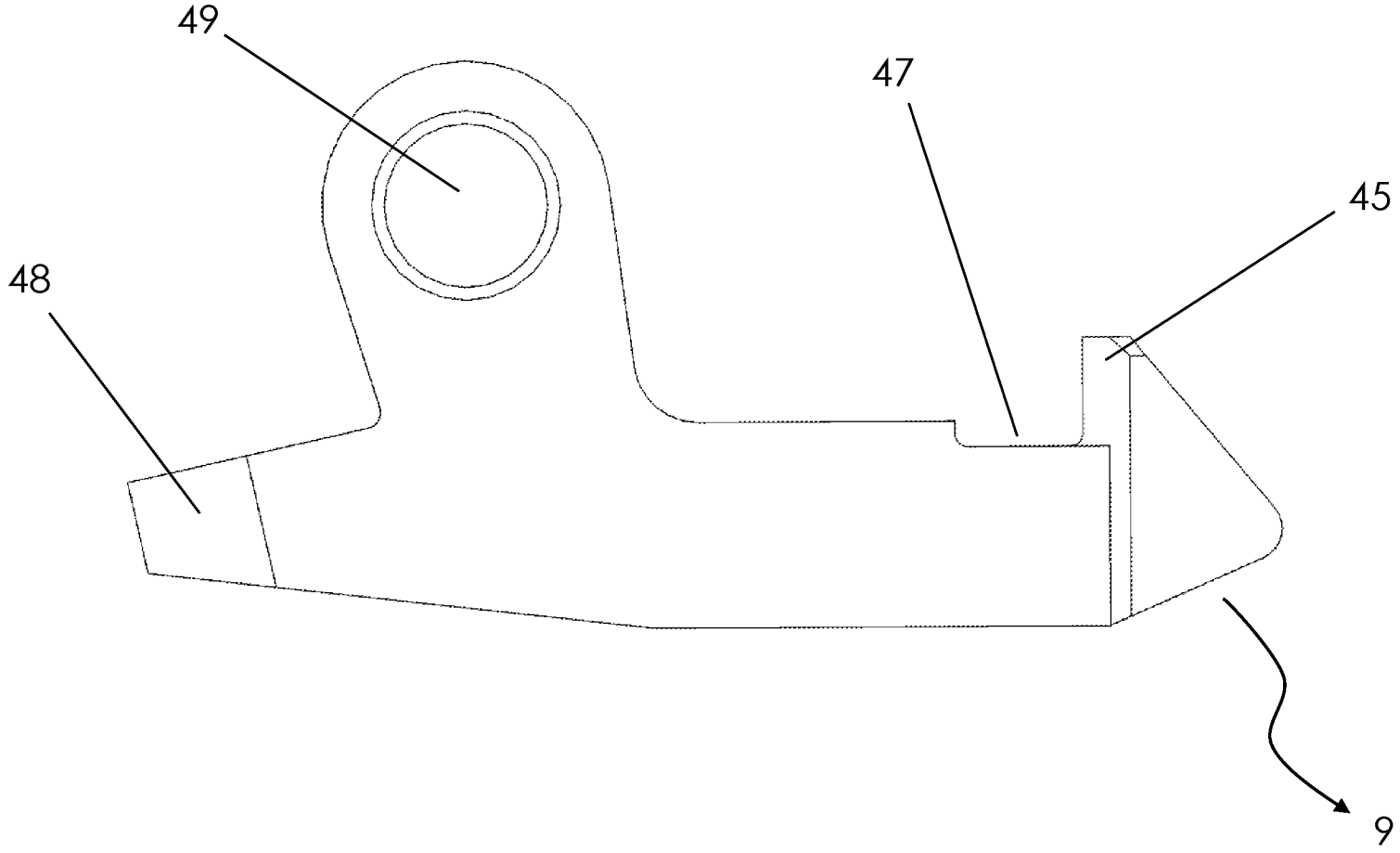

Extractor (9) structure, as can be seen in FIG. 10, comprises an extractor pin housing (49) in the form of space at its middle section. Process of positioning the extractor (9) in extractor housing (33) is carried out by means of extractor pin housing (49). Extractor (9) structure, which is positioned in extractor housing (33) such that extractor pin housing (49) stays inside, are fastened by means of extractor pin (12) positioned in extractor cavities (22) on the upper side of mechanism head (14). Extractor cavities (22) are structures in the form of two cylindrical spaces that are positioned symmetrically according to each other on the upper side of mechanism head (14). Said extractor pin (12) goes through extractor pin housing (49) by keep proceeding after entering in extractor cavity (22). Therefore, extractor (9) structure can be positioned in extractor housing (49) by means of extractor pin (12).

There is a spring protrusion (48) facilitating the extractor (9) to move at the back end, which is in a opposite direction of barrel, of extractor (9) structure positioned in extractor housing (33) by means of extractor pin (12). Spring protrusion (48) coincides exactly with the extractor spring cavity (32) when extractor (9) structure is positioned in extractor housing (33). Extractor spring cavity (32) is on the back end of extractor housing (33). Extractor spring (10) is positioned in extractor spring cavity (32). Thus, extractor spring (10) remains between extractor spring cavity (32) and spring protrusion (48). Extractor (9) structure may conduct circular movements depending on jamming and expanding movements of extractor spring (10) such that it takes the extractor pin (12) as the center.

Extractor (9) structure is at the end on front side of mechanism head (14). Since the location in which mechanism head (14) exists is the very back portion of barrel (61) structure, the extractor (9) structure stays exactly behind the barrel (61) structure. Even end portion of extractor (9) structure facing towards the barrel (61) makes a contact with the cartridge structure positioned in the barrel (61) so as to be fired. There is a cartridge holding protrusion (45) in the inward protruding form, which can be seen in FIG. 10, at the end portion of the extractor (9) facing to barrel. Cartridge holding protrusion (45) is a structure that is designed so as to grip the base edge which exists in the base of cartridge in barrel and protrudes outward. There is a cartridge base space (47) in the immediate interior portion of cartridge holding protrusion (45). Thus, when cartridge holding protrusion (45) grips the protrusion at the cartridge base, said protrusion at the cartridge base is seated exactly on the cartridge base space (47). Thus, cartridge holding protrusion (45) can grip ideally the cartridge base.

Main objective of the extractor (9) is to move the empty cartridge case that remains in the barrel backward by means of mechanism after firing processes is conducted. It is possible to move the empty cartridge case by means of cartridge holding protrusion (45) and cartridge base space (47). Extractor (9) enables the empty case to strike to ejector by moving the empty cartridge case backward and to eject it out of firearm structure.

Figure 11:
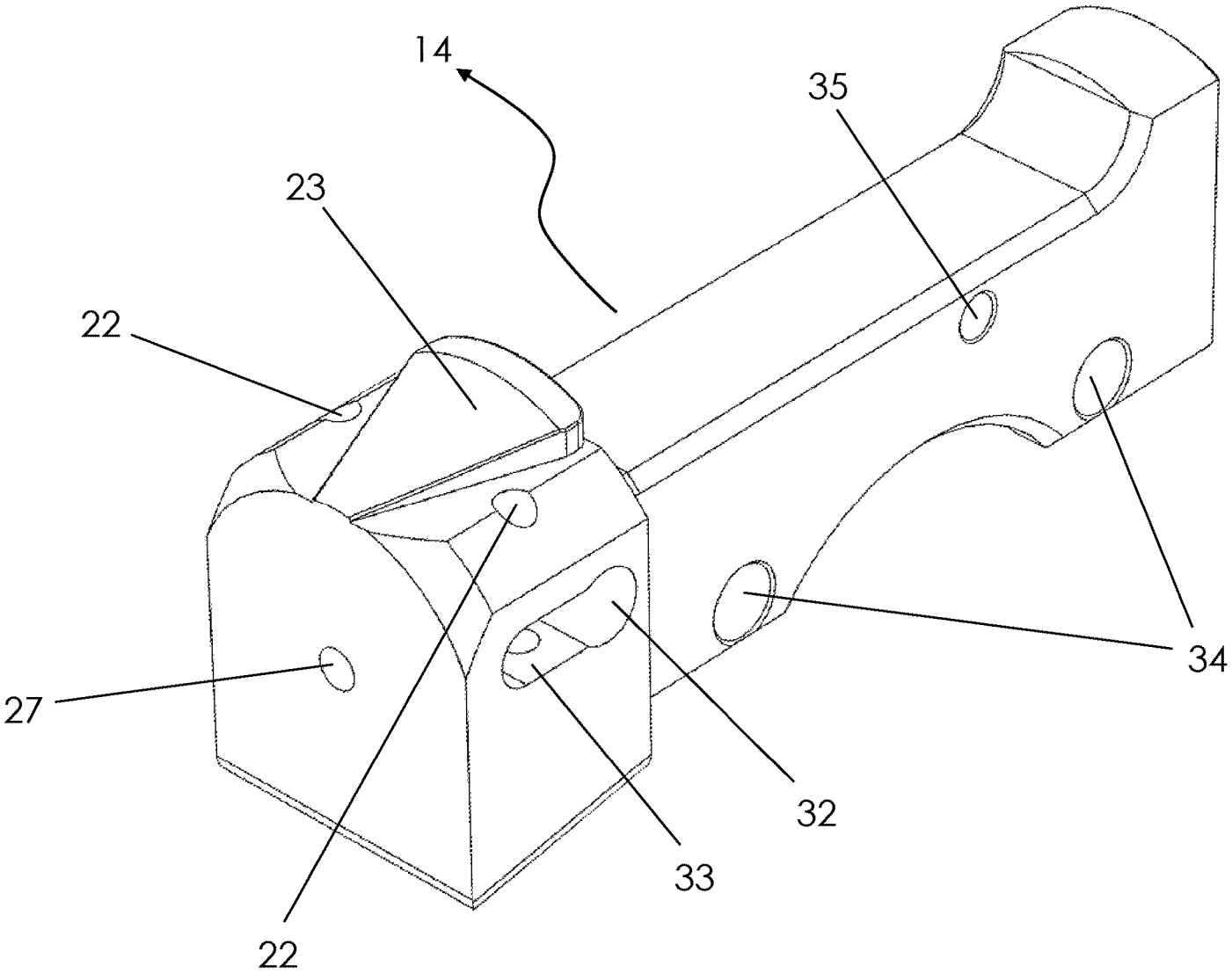
Figure 27:
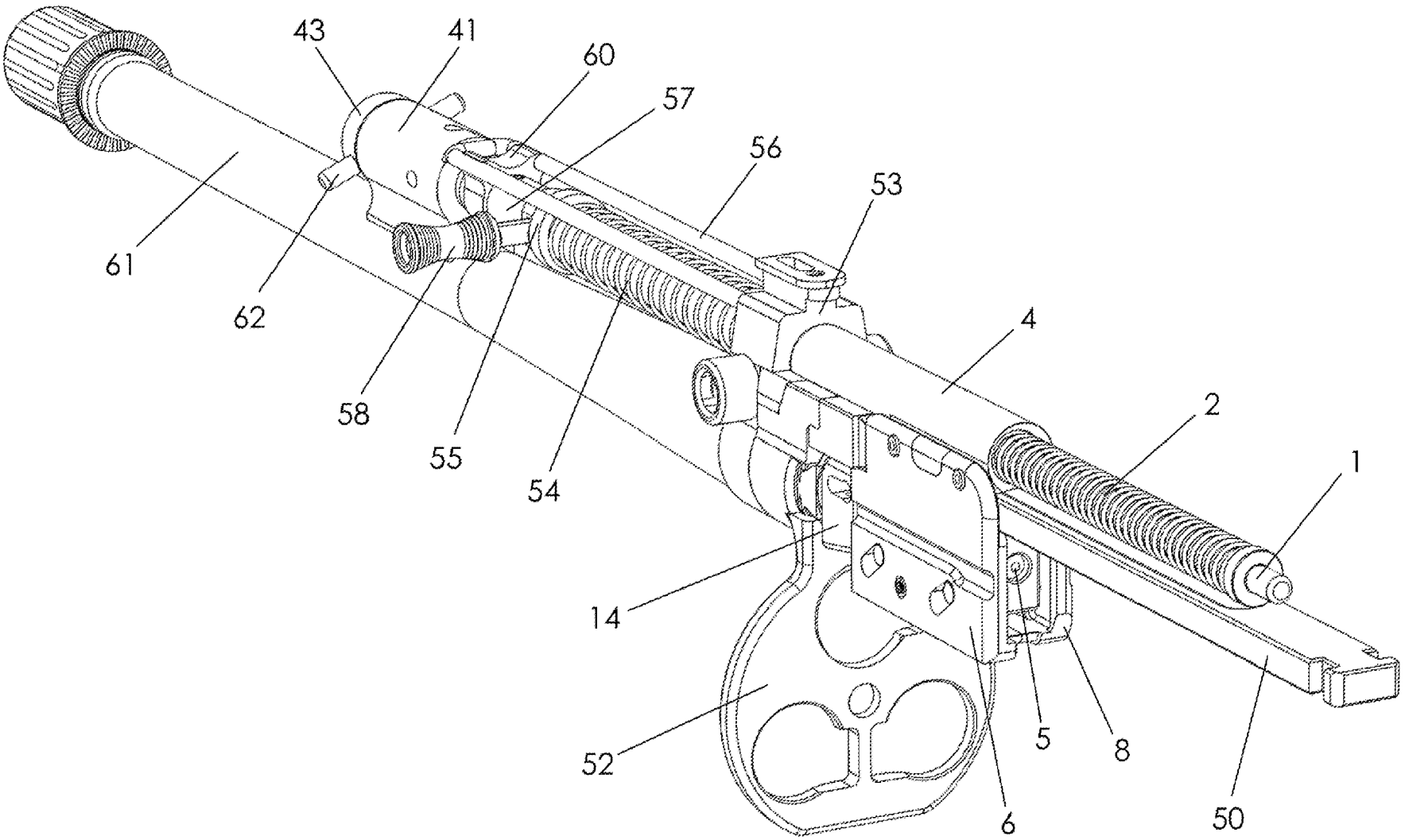
Figure 28:
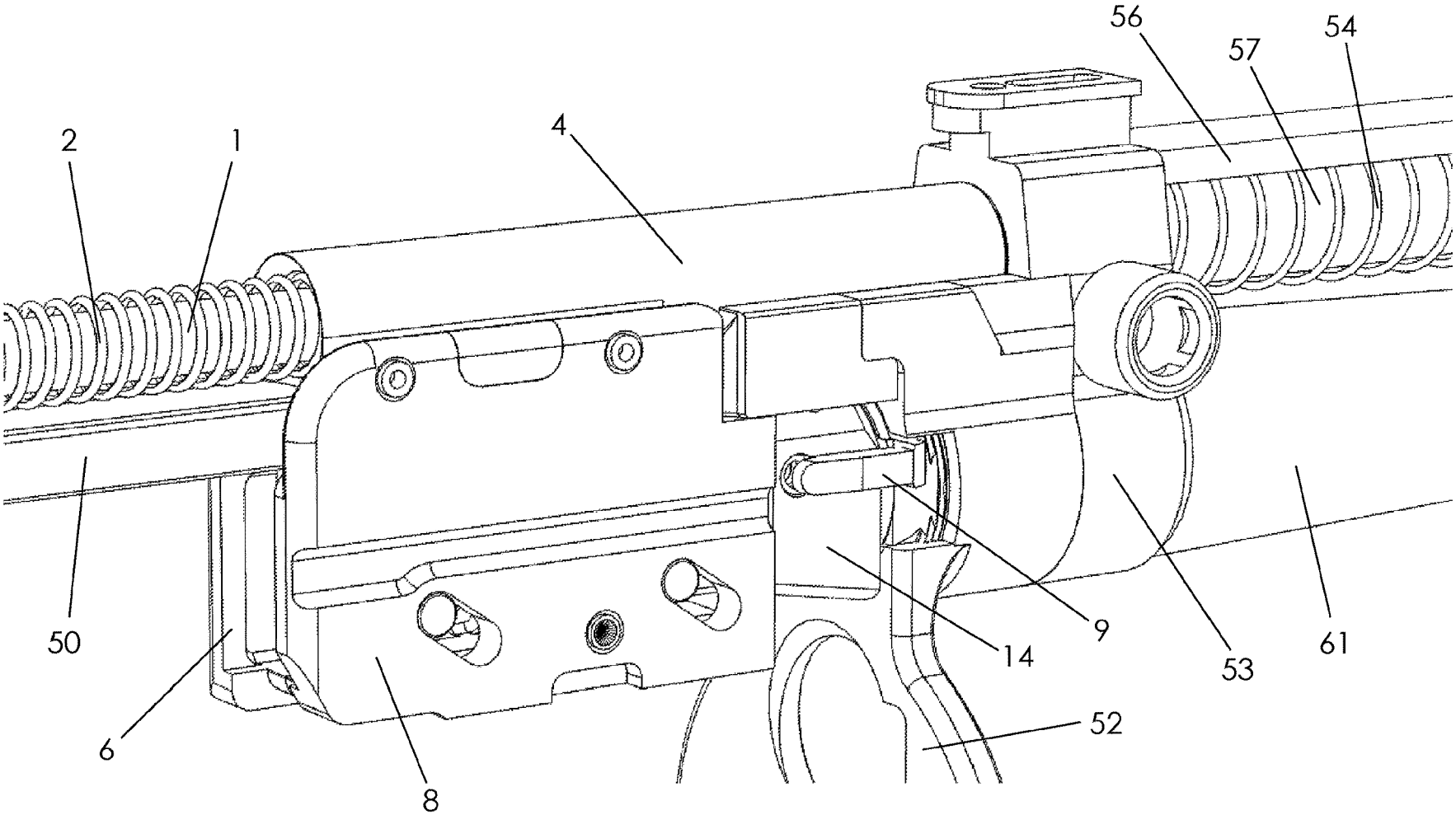

There is a lock protrusion (23) in the protruding form that looks like a triangle when looked from top, as can be seen in FIG. 11, on the upper surface of wide section in front side of mechanism head (14). Said lock protrusion (23) is one of the most important members contacting the mechanism group and barrel group to each other. Mechanism rail (50) that is the backmost component of barrel group, as can be seen in FIG. 27, is positioned between said two structures such that it coincides immediately with upper side of the mechanism head (14) and immediately with underneath of recoil spring tube (4). On the lower surface of mechanism rail (50), there is a lock housing (51) in a space form in the section coinciding with lock protrusion (23) on the mechanism head (14). Space form that lock housing (51) comprises is in a form and structure that exactly fits in lock protrusion (23). Main objective of the mechanism rail (50) is to lock mechanism head (14) for the purpose of pushing the bullet shot from cartridge by the effect of firing pressure in the course of firing.

Mechanism head (14) enables to shoot the bullet through barrel (61) by pushing it by means of gas pressure arisen from the explosion of the cartridge in the barrel by fastening to barrel (61). Mechanism head (14) moves downward and forward traversely during its movement towards the barrel (61) thanks to its design, wherein it is locked to barrel (61) by moving upward and backward in the axis of movement holes (17) after its movement towards barrel (61) is finished. Mechanism head (14) prevents powder gas pushing bullet or shots from leaking by delaying first movement of mechanism pushed back after cartridge is fired until bullet or shots leave the barrel (61). At this point, firstly lock protrusion (23) on the mechanism head (14) leaves from the lock housing (51) on lower surface of mechanism rail (50) therein. After that, mechanism head (14) moves downward. It moves backward as a whole with the components in mechanism head (14) after mechanism head (14) and mechanism rail (50) separate from each other. Mechanism head (14) enables to position both lock and cartridge in barrel (61) by way of pushing them.

Figure 18:
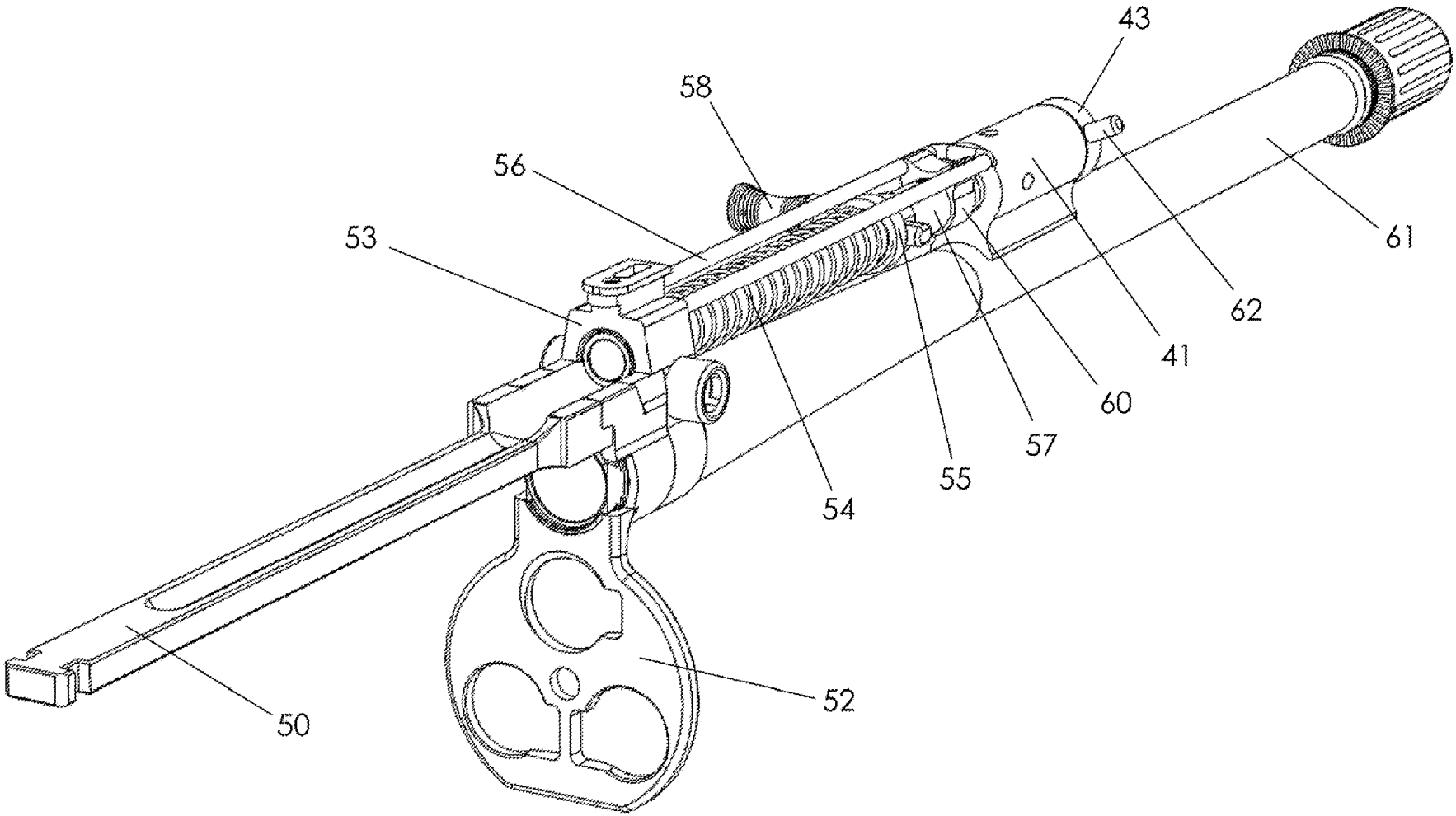
FIG. 18. Mounted barrel group—Back perspective view
Figure 19:
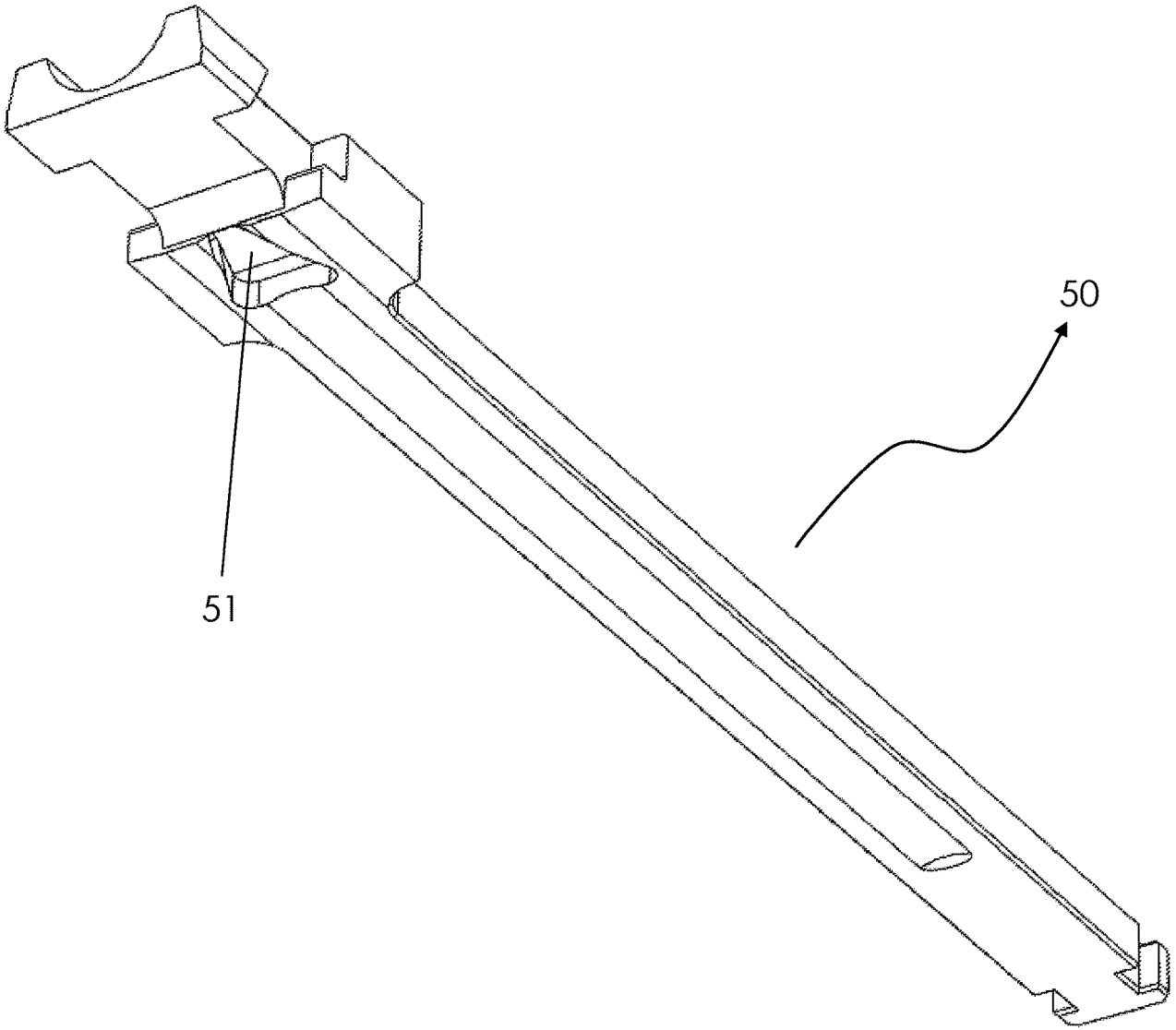
FIG. 19. Mechanism rail—Bottom perspective view

There is magazine disc (52) at the front end facing to barrel (61) of mechanism rail (50). Back end of the barrel (61) exists in the magazine disc (52). As can be seen in FIG. 18, upper portion of the magazine disc (52) comprises a structure that can be mounted to mechanism rail (50). This allows said two structures to stay in a stabile position according to each other. Therefore, Types of montage between said structures may preferably in the form of various structures, different protrusion forms and space forms according to those.

Figure 20:
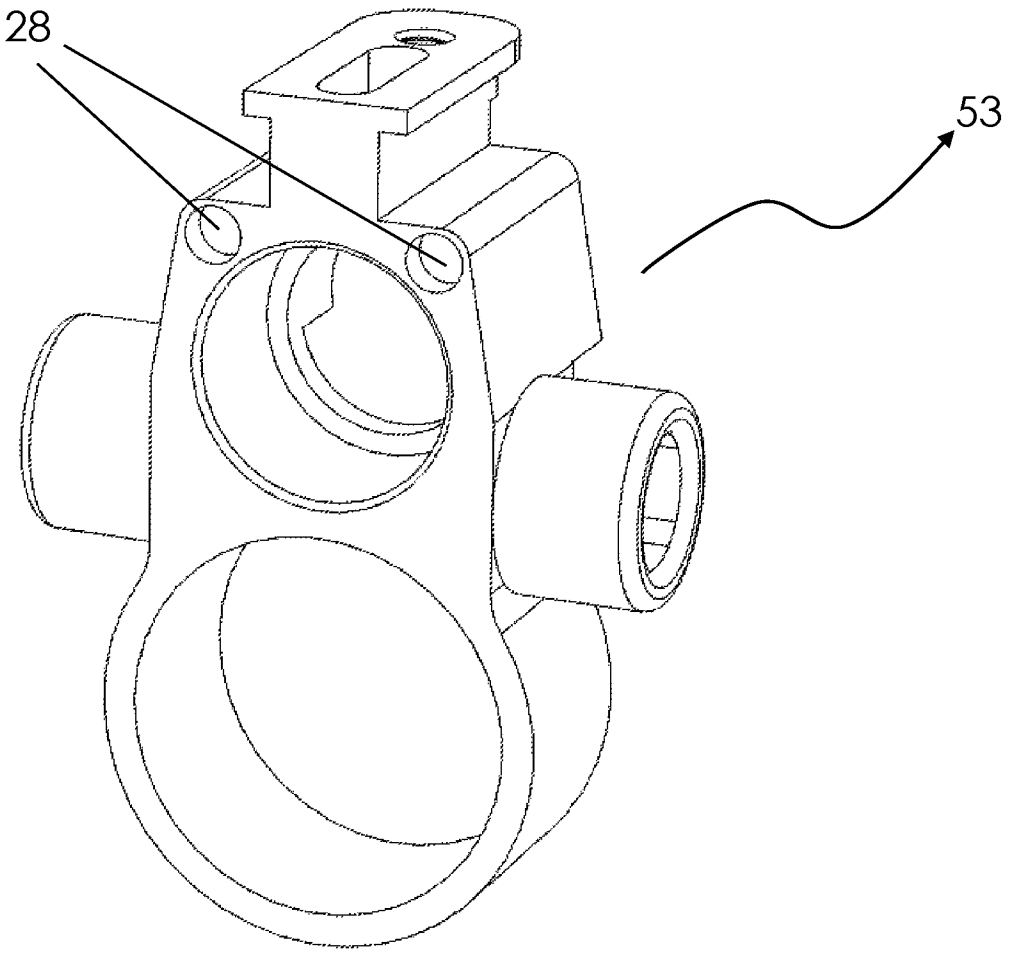
FIG. 20. Barrel crown—Perspective view
Figure 21:
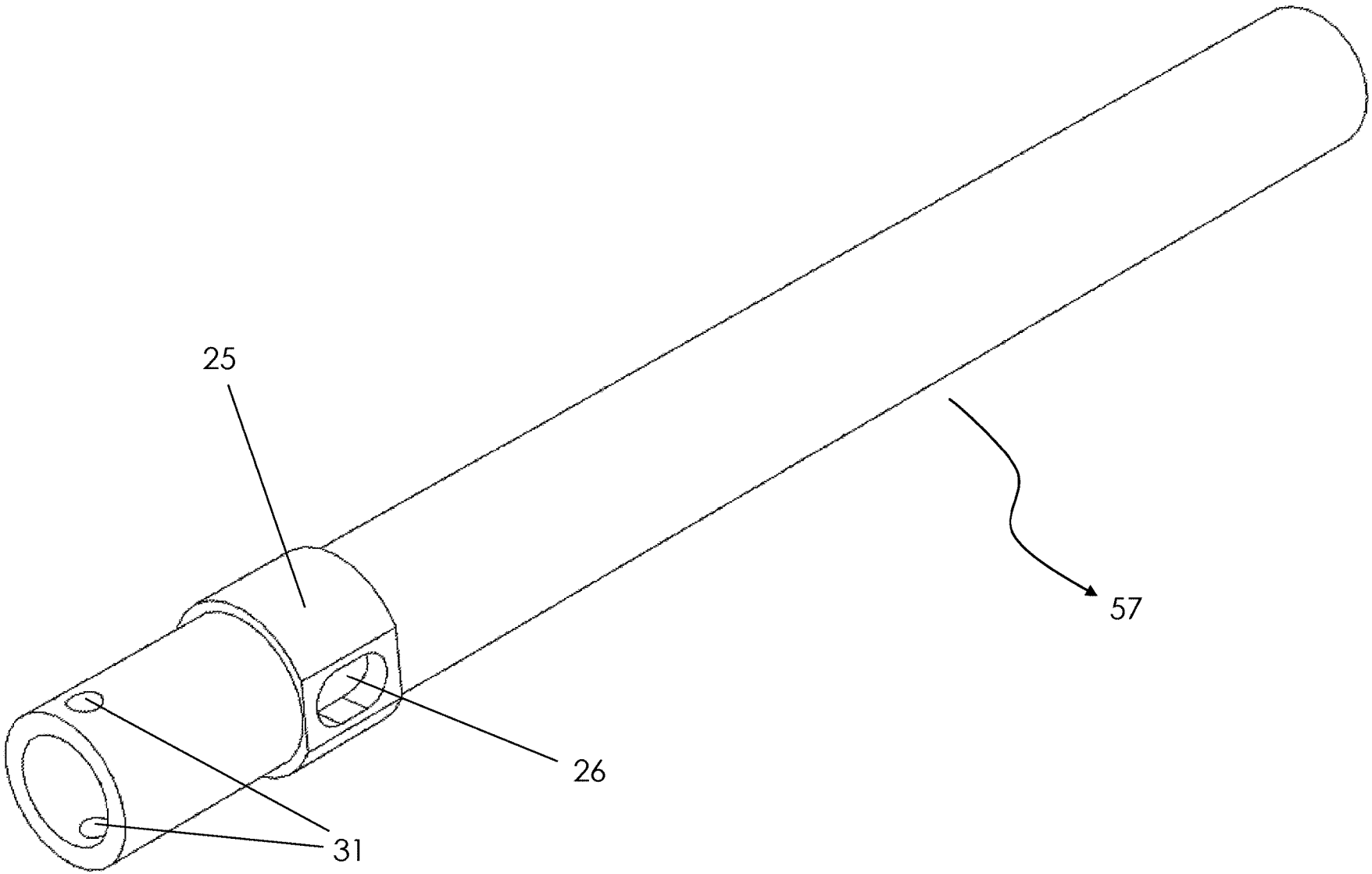
FIG. 21. Push tube—Perspective view

There is a barrel crown (53) structure immediately in the front portion of mechanism rail (50) and magazine disc (52) in a mounted to each other form. The barrel crown (53) that can be seen in FIG. 20 is in a very important and critical point. Basically, it is a structure that has two circular spaces positioned upside-down. Back end of the barrel (61) goes through the lower space of the barrel crown (53) before entering in magazine disc (52). Its upper space serves as a juncture of recoil spring tube (4) and push tube (57). Its main objective is to move synchronously the barrel (61) structure at its lower portion and the push tube (57)-recoil spring tube (4) that move based on gas at its upper portion.

Push tube (57) is positioned on the barrel (61) structure such that it coincides with immediate front portion of recoil spring tube (4). Back end of the push tube (57) stays in the barrel crown (53). Push tube (57) moves mechanism head (14) backward by pushing the movement obtained from gas piston (42) in the gas chamber (41) at its front side to recoil spring tube (4) in the course of firing. In case of a normal position without firing, while recoil spring tube (4) and push tube (57) do not make a contact with each other, the movement arisen by means of gas pressure in the course of firing opens the lock and feeds the firearm by contacting subsequently these three component to each other.

There is a push spring (54) on the push tube (57). Push spring (54) is positioned on the push tube (57) such that it is at the back portion thereof. A cocking handle segment (55) is attached in front of push spring (54). Cocking handle segment (55) restricts movements of the push spring (54) and prevents push tube (57) from releasing from its front end. Since back end of the push spring (54) enters in the barrel crowns (53) along with the push tube (57), push spring (54) is squeezed between cocking handle segment (55) and recoil spring tube. Main objective of the push spring (54) is to enable the push tube (57) moving from front side towards back side to take its first position by means of the effect of movement obtained from gas piston or cocking handle (58).

Since cocking handle segment (55) has a smaller diameter than the cocking handle protrusion (25) in the protruding form on the push tube (57), it is not possible to go over the cocking handle protrusion (25). There is cocking handle housing (26) on side surface of the section in which cocking handle protrusion (25) exists. Cocking handle housing (26) is the structure in which cocking handle (58) is positioned. Cocking handle segment (55) fastens cocking handle (58) into cocking handle housing (26) by means of pushing the cocking handle segment (5) at the front side of push spring (54).

Cocking handle (58) basically enables to cock the firearm by drawing mechanism backward by a user, to load cartridge in the barrel and make it ready to fire. It has an ergonomic design which user can easily move with his/her finger. It can be attached to right side or left side according to user's preference thanks to symmetrical design of the cocking handle housing (26).

Figure 22:
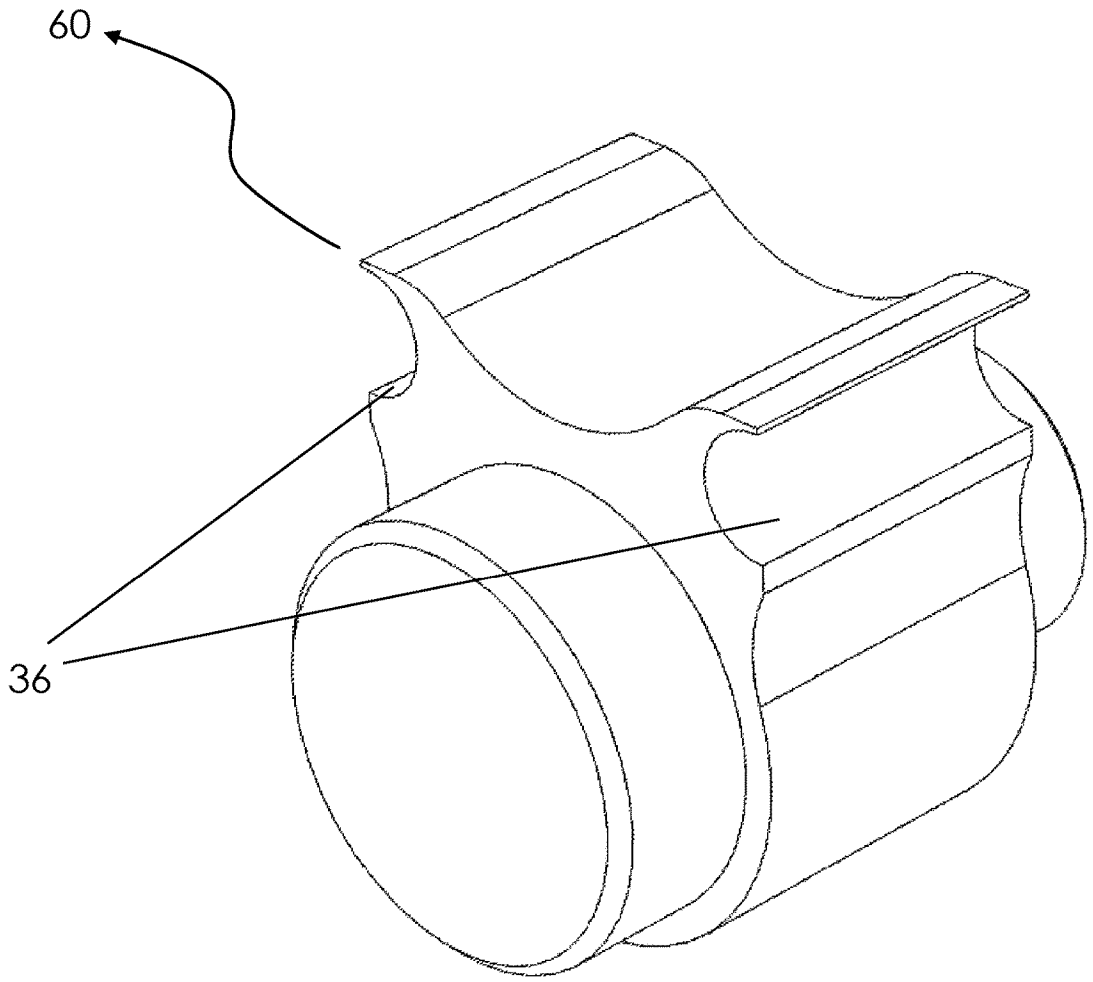
FIG. 22. Tube lid—Front perspective view
Figure 23:
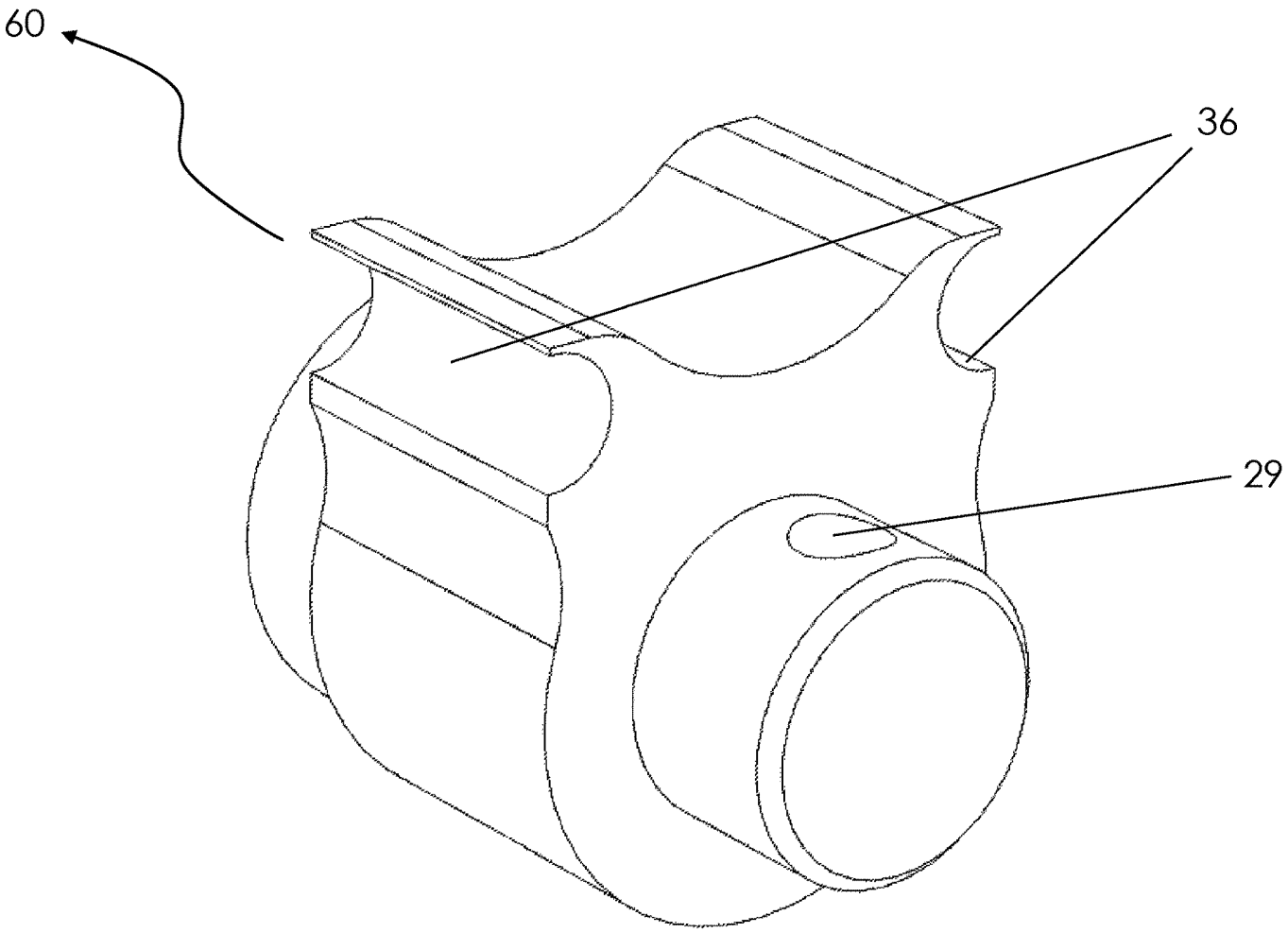
FIG. 23. Tube lid—Back perspective view
Figure 24:
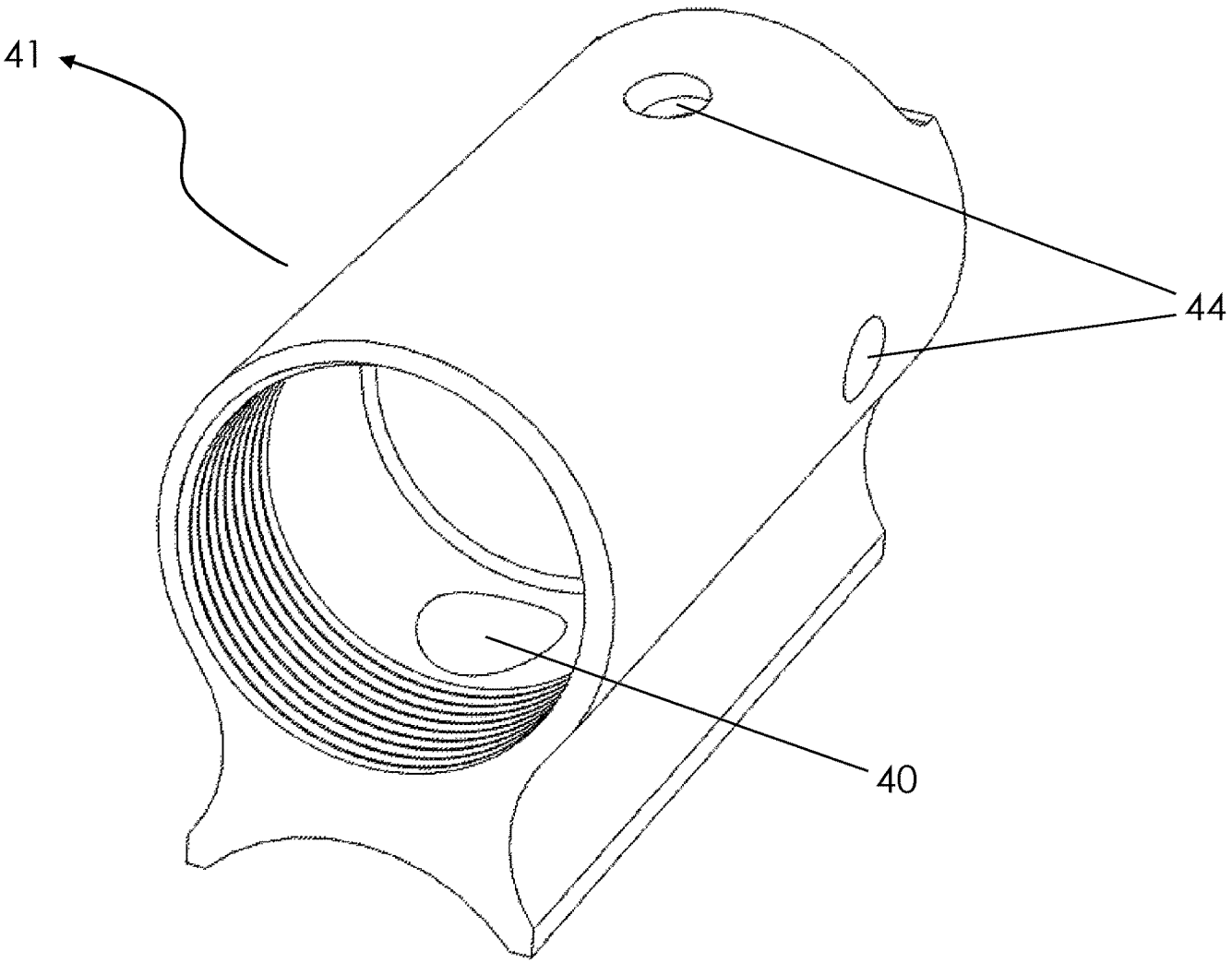
FIG. 24. Gas chamber—Front perspective view
Figure 25:
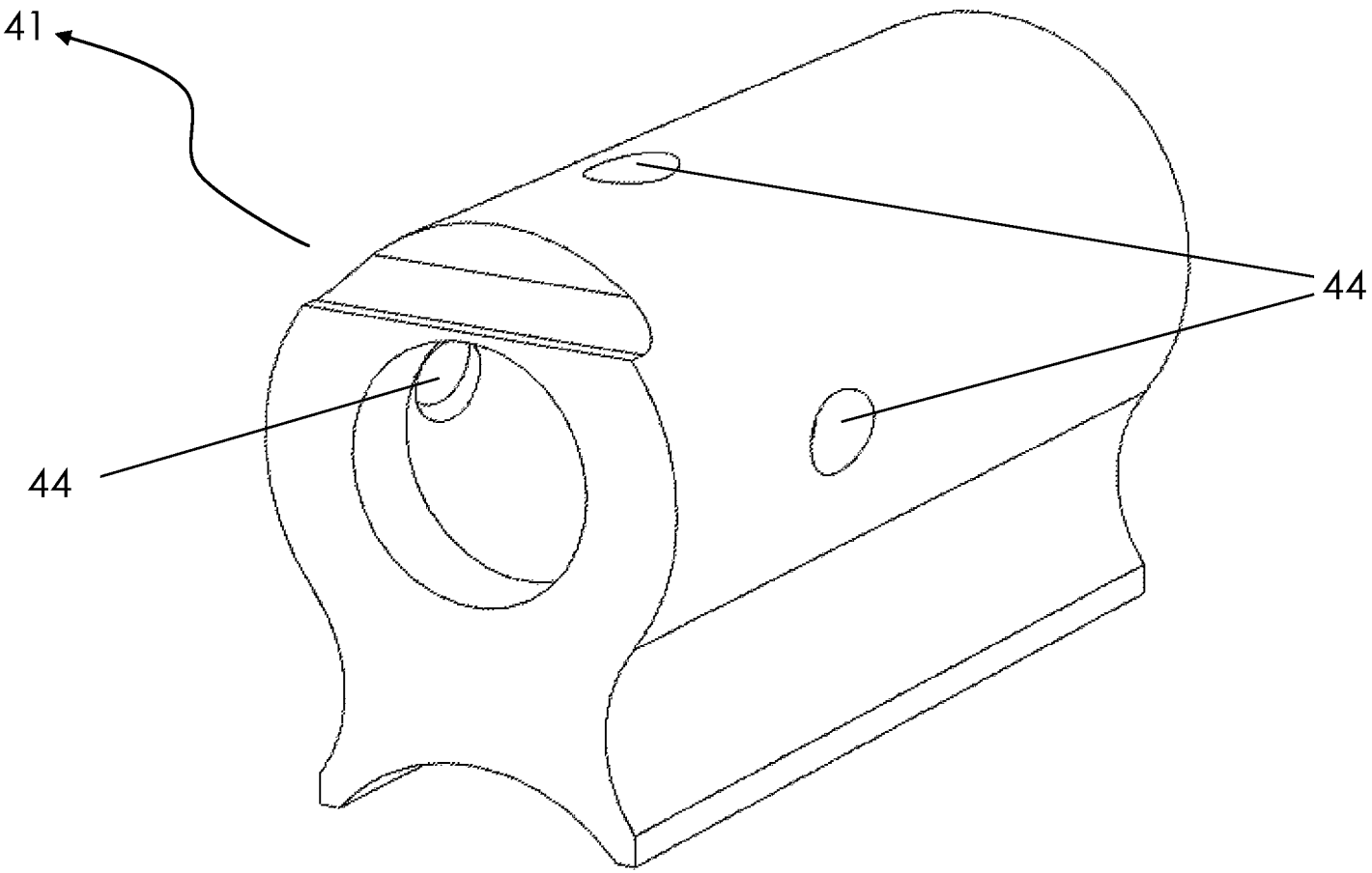
FIG. 25. Gas chamber—Back perspective view
Figure 26:
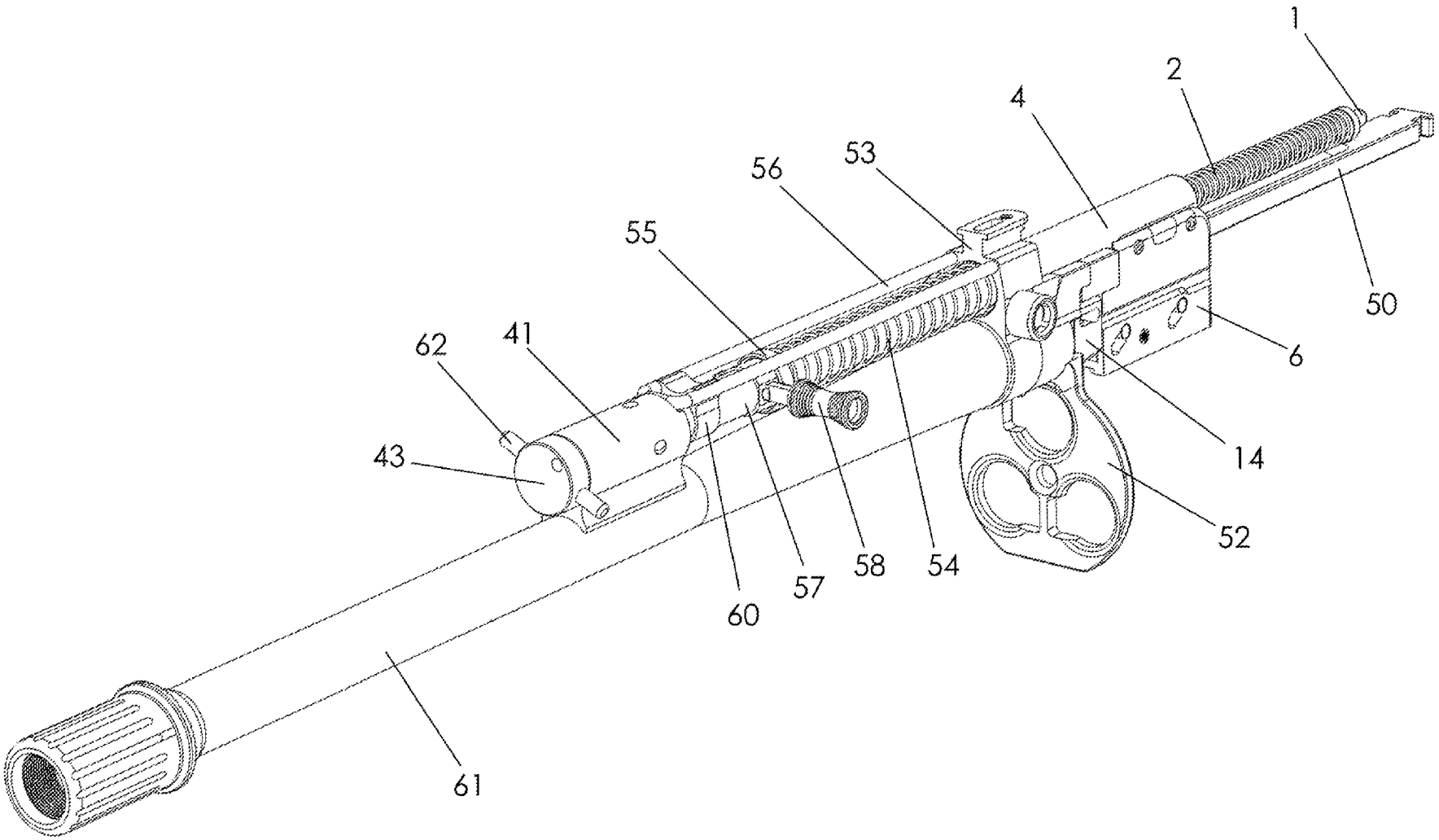
FIG. 26. Mechanism group mounted to each other and barrel group—Front perspective view FIG. 27. Mechanism group mounted to each other and barrel group—Back perspective view FIG. 28. Close view of mechanism head portion in the mechanism group mounted to each other and barrel group The parts shown in the figures are enumerated individually and names of the parts corresponding to these numbers are given below.

A tube lid (60) is attached to front end of the push tube (57) structure. Said tube lid (60), as can be seen in FIG. 22, has a structure in the cylindrical form. An end of tube lid (60) has a structure that can enter in front end of the push tube (57) structure. There are pin cavities (29), which are positioned on the two opposed edge and are in a uniform space form comprising a structure in which push tube pin (59) can enter, on the end of tube lid (60) that can enter in push tube (57). Similarly, there are push tube holes (31) on the two edges that coincide with upper side of pin cavities (29) of the push tube (57). Push tube holes (31) exist exactly on the pin cavities (29) and tube lid (60) and push tube (57) are firmly mounted to each other by means of one push tube pin (59) that is positioned in said cavity structures.

Figure 16:
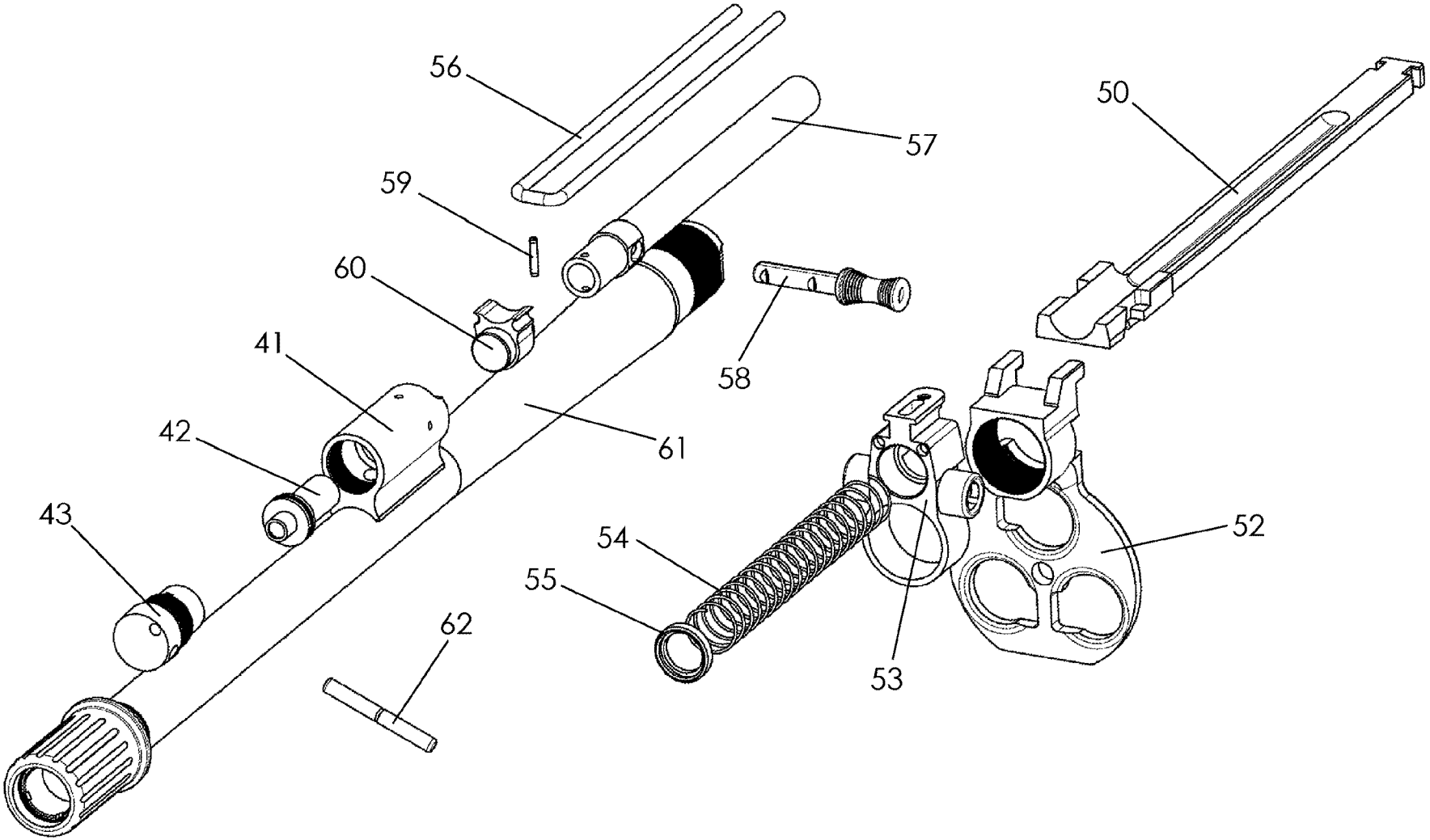
FIG. 16. Unmounted barrel group—Perspective view
Figure 17:
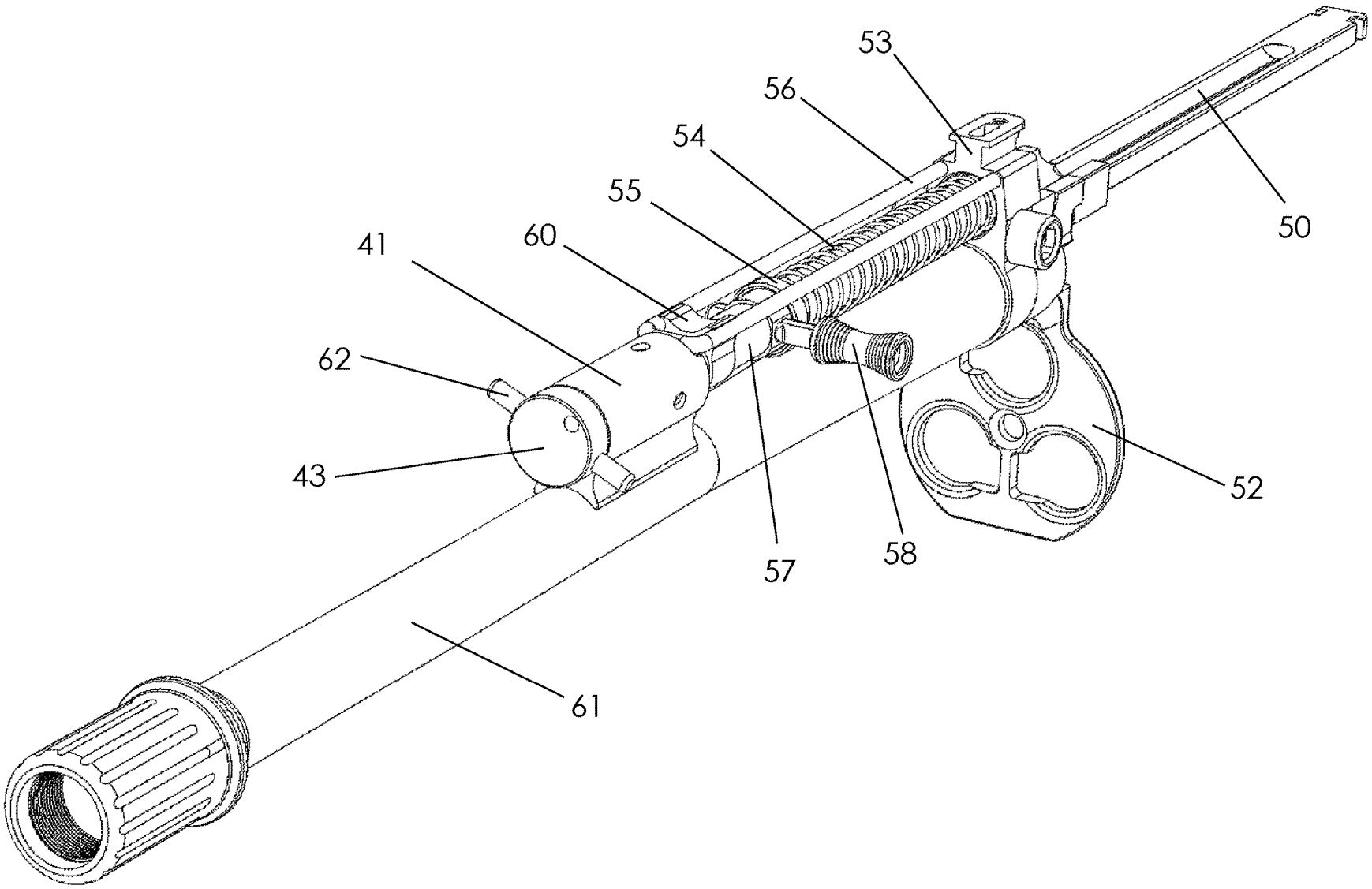
FIG. 17. Mounted barrel group—Front perspective view

As can be seen in FIG. 22, there are push rail spaces (36), which are in a symmetrical structure according to each other, at both sides of upper section of the tube lid (60) that is positioned at the front end of push tube (57). Said push rail spaces (36) are the space structures in which push rail (56)

that can be seen in FIG. 16 can be positioned from both sides therein. Push rail (56) is comprised of two, thin and uniform tube structures which are positioned immediately on the push tube (57) structure, are in a parallel position to the push tube (57) and are in parallel location to each other. Push rail (56) structure is positioned such that it goes through push rail spaces (36) on the tube lid (60).

Both free ends of push rail (56) enter separately in two push rail housing (28) on the barren crown (53). Therefore, push rail (56) structure is in a stabilized position. Main objective of the push rail (56) is to move push tube (57) in a parallel direction to the barrel (61) axis. It appoints the movement axis of push tube (57).

There exists gas chamber (41) immediately in front of free end of facing to barrel (61) muzzle of the tube lid (60) that is positioned in the front portion of push tube (57). Gas chamber (41) is positioned on the barrel (61) structure. There exists gas piston (42) exactly in the middle of gas chamber (41). Gas piston (42) is the leading one of structures initiating the movements which the mechanism carries out with the effect of gas pressure arisen from firing. Gas piston (42) both exists in gas chamber (41) and is positioned such that its back end is exactly in front of tube lid (60). Therefore, it allows tube lid (60) to move push tube (57) backward by striking to tube lid (60) in the moment in which it moves backward with the effect of gas pressure. Thus, the push tube (57) moving backward strikes to recoil spring tube (4) at its back. Recoil spring tube (4) enables firing circle to be completed by means of transmitting the movement obtained from push tube (57) to the mechanism. At this point, recoil spring (2) allows the mechanism sliding backwards by the drive obtained from the push tube (57) to move back towards barrel (61) and be locked.

There exists a gas hole (40) in the area taking place on the barrel (61) in the interior surface of gas chamber (41). Said gas hole (40) transmits the gas in barrel (61) to the gas chamber (41). There exist multiple discharge holes (44) positioned to be at least one on the upper surface of gas chamber (41) which does not make a contact with the barrel (61) and faces outwards. Main objective of the discharge holes (44) is to discharge the excessive gas and to enable gas residues/particles entered in gas chamber (41) to be discharged in case there is too much burnt powder gas filled in the gas chamber (41). Thus, it is ensured that gas chamber (41) gets dirty later than the usual, and to increase the firing number that requires cleaning. There exists a gas chamber lid (43) at the end portion of gas chamber (41) facing towards end of the barrel (61). Gas chamber lid (43) keeps gas chamber (41) closed. It is fastened by means of lid pin (62).

It is provided a new mechanism that can be used in both rifles and shotguns by means of the mechanism structure subject to the invention. It is provided a structure with higher efficiency by means of designs of the components which constitute the structure of said mechanism. It is provided a new firing power increased mechanism by means of structures that are employed during use of gas pressure and said structures' interaction with each other.

The invention claimed is:

1. A firearm apparatus comprising:

a barrel structure;

a mechanism head positioned at a back of said barrel structure, said mechanism head comprising:

a firing pin housing positioned at an end of said barrel structure;

a firing pin positioned in said firing pin housing;

a tether pin housing positioned on said firing pin housing;

a tether pin positioned in said tether pin housing, said tether pin cooperative with said firing pin;

an extractor housing positioned so as to face said barrel structure;

an extractor positioned in a space of said extractor housing;

a lock protrusion having a protruding structure facing toward said barrel structure, the protruding structure having a triangular shape; and a mechanism rail having a lock housing on a lower surface thereof, the protruding structure fitting into the lock housing;

a tether bearing positioned on a bearing cutout of said firing pin;

a pin spring having a thin end facing forwardly and outwardly of a firing pin cavity of said firing pin;

a cartridge holding protrusion holding a cartridge base, said cartridge holding protrusion positioned in said extractor housing;

a barrel crown having said barrel structure positioned thereunder, said barrel crown having a push tube and a recoil spring tube positioned thereon, said barrel crown positioned immediately in front of a magazine disc so that said barrel crown resides immediately rearwardly of said barrel structure, the push tube being positioned on an upper portion of said barrel structure such that a back end of the push tube is received in said barrel crown, the push tube comprising a cocking handle protrusion stopping a cocking handle segment at an end portion facing an end of said barrel structure, said push tube further comprising a cocking handle housing having a cocking handle therein, the cocking handle positioned on a side surface of the cocking handle protrusion so as to enable said mechanism head to slide backwardly by transmitting movement obtained from a gas piston in a gas chamber to recoil the spring tube; and a tube lid positioned in a front end of the push tube, said tube lid being mounted to the push tube by a push tube pin positioned in a pin cavity at an end entering the push tube so as to transmit movement obtained from the gas piston to the push tube, wherein the gas chamber is positioned on said barrel structure so as to be in front of said tube lid, the gas chamber receiving gas resulting from firing such that the received gas causes the gas piston to initiate movement, the gas chamber having a gas hole therein, the gas hole adapted to release the gas from said barrel structure, the gas chamber having discharge holes adapted to discharge excess gas and particles from the gas chamber.

2. The firearm apparatus of claim 1, wherein the recoil spring tube is positioned on said mechanism head between upper edges of a mechanism left cover and a mechanism right cover, the recoil spring tube having wide tube protrusions positioned symmetrically on side surfaces thereof, the recoil spring tube having four small tube protrusions positioned on edges of the wide tube protrusions, said recoil spring tube comprising a rod housing in which a guide rod and a recoil spring are positioned at a back end thereof, the mechanism left cover being positioned on a side of said mechanism head opposite to said mechanism right cover, the mechanism left cover being mounted to the mechanism right cover by a mounting pin positioned in a cover pin housing, the cover pin housing having a pair of movement holes arranged at a 35° angle, the cover pin housing having a wide tube housing positioned on the wide tube protrusions and a pair of small tube housings positioned on opposite sides of the wide tube housing at an upper edge thereof.

3. The firearm apparatus of claim 1, further comprising:

a push rail positioned on the push tube, said push rail having a pair of thin uniform tube structures arranged parallel to each other and positioned so as to go through spaces in said push rail, the pair of uniform tube structures having ends that separately enter push rail housings on said barrel crown so as to allow movement of said push tube along a direction parallel to an axis of said barrel structure;

a mechanism rail positioned on said mechanism head under the recoil spring tube, said mechanism rail having a lock housing corresponding to a lock protrusion on a lower surface of said mechanism head and adapted to lock said mechanism head for pushing a bullet from a cartridge by explosion pressure resulting from firing the firearm apparatus; and a magazine disc having an upper portion mounted to said mechanism rail and positioned in the back end of said barrel structure.

4. The firearm apparatus of claim 1, further comprising:

a segment housing in which a pin segment is positioned and which extends toward a lower surface of said mechanism head;

a pair of head pin housings positioned on side surfaces of said segment housing and residing adjacent said mechanism head;

an exterior spring cavity at a back end of said extractor housing; and a pair of extractor cavities positioned symmetrically on opposite sides of the lock protrusion on an upper surface of said mechanism head, said pair of extractor cavities having a cylindrical shape so as to enable said extractor to be positioned in said extractor housing.

5. The firearm apparatus of claim 1, further comprising:

a pair of push rail spaces positioned symmetrically on opposite sides of an upper section of said tube lid; and a pin cavity positioned on two opposed edges at an end of said tube lid that enters the push tube.

6. The firearm apparatus of claim 1, wherein the gas piston is positioned in the gas chamber such that a back end of the gas piston is in front of said tube lid, the firearm apparatus further comprising:

a gas chamber lid positioned on an end portion of the gas chamber that faces toward an end of said barrel structure, said gas chamber lid being fastened to the gas chamber by a lid pin and adapted to keep the gas chamber closed.

7. The firearm apparatus of claim 1, wherein the extractor pin housing has a space that allows an extractor pin to enter the extractor pin housing, the space being located in a middle of the extractor so as to enable the extractor to be fastened in said extractor housing by means of the extractor pin being pushed into and through an exterior cavity on said mechanism head, the firearm apparatus further comprising:

a spring protrusion having an end facing said extractor so as to allow said extractor to move around the extractor pin.

* * * * *